US008016661B2

(12) United States Patent
Yoshizawa

(10) Patent No.: US 8,016,661 B2
(45) Date of Patent: Sep. 13, 2011

(54) GAMING SYSTEM COMPRISING A PLURALITY OF SLOT MACHINES AND METHOD FOR CONTROLLING GAMING MACHINE

(75) Inventor: Kazumasa Yoshizawa, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 484 days.

(21) Appl. No.: 12/347,307

(22) Filed: Dec. 31, 2008

(65) Prior Publication Data

US 2009/0215522 A1 Aug. 27, 2009

Related U.S. Application Data

(60) Provisional application No. 61/031,176, filed on Feb. 25, 2008.

(51) Int. Cl.
*A63F 9/24* (2006.01)

(52) U.S. Cl. ..... 463/20

(58) Field of Classification Search ..... 463/20
See application file for complete search history.

(56) References Cited

U.S. PATENT DOCUMENTS

| | | | | |
|---|---|---|---|---|
| 6,224,484 | B1 | 5/2001 | Okuda et al. | |
| 2002/0025843 | A1 | 2/2002 | Bryant | |
| 2009/0124345 | A1 * | 5/2009 | Gilmore et al. | 463/20 |
| 2009/0215522 | A1 * | 8/2009 | Yoshizawa | 463/20 |

* cited by examiner

*Primary Examiner* — George Fourson, III
(74) *Attorney, Agent, or Firm* — NDQ&M Watchstone LLP

(57) ABSTRACT

A gaming system of the present invention is programmed to execute processes of: changing symbols arranged on a sub display in such a way as to scroll symbols in a lateral direction in a display zone comprising sub displays in the respective slot machines, the sub displays being connected laterally to one another; then stopping the changing of symbols at predetermined timing; and at this stoppage, providing an award on a basis of the symbol arranged on the sub display.

8 Claims, 17 Drawing Sheets

Fig. 4

| | First column | Second column | Third column | Fourth column | Fifth column |
|---|---|---|---|---|---|
| Code No. | Symbol | Symbol | Symbol | Symbol | Symbol |
| 00 | JACKPOT 7 | JACKPOT 7 | JACKPOT 7 | JACKPOT 7 | JACKPOT 7 |
| 01 | PLUM | BELL | CHERRY | ORANGE | APPLE |
| 02 | ORANGE | APPLE | ORANGE | PLUM | ORANGE |
| 03 | PLUM | BELL | APPLE | STRAWBERRY | BELL |
| 04 | ORANGE | CHERRY | ORANGE | BELL | PLUM |
| 05 | PLUM | ORANGE | PLUM | PLUM | BLUE 7 |
| 06 | ORANGE | PLUM | ORANGE | APPLE | ORANGE |
| 07 | PLUM | CHERRY | PLUM | BLUE 7 | APPLE |
| 08 | BLUE 7 | BELL | ORANGE | PLUM | PLUM |
| 09 | CHERRY | APPLE | PLUM | ORANGE | BELL |
| 10 | ORANGE | BELL | ORANGE | BELL | CHERRY |
| 11 | BELL | STRAWBERRY | PLUM | ORANGE | PLUM |
| 12 | ORANGE | PLUM | BELL | PLUM | BELL |
| 13 | STRAWBERRY | BLUE 7 | STRAWBERRY | CHERRY | ORANGE |
| 14 | BLUE 7 | BELL | BLUE 7 | APPLE | APPLE |
| 15 | ORANGE | APPLE | BELL | STRAWBERRY | PLUM |
| 16 | APPLE | BELL | CHERRY | CHERRY | CHERRY |
| 17 | PLUM | STRAWBERRY | PLUM | BELL | ORANGE |
| 18 | ORANGE | PLUM | ORANGE | PLUM | BELL |
| 19 | PLUM | CHERRY | PLUM | ORANGE | ORANGE |
| 20 | BLUE 7 | BELL | ORANGE | CHERRY | PLUM |
| 21 | CHERRY | APPLE | PLUM | PLUM | STRAWBERRY |

Fig. 10

| Prize | Possibility of establishment (%) | Number of coin-outs (※1) |
|---|---|---|
| Bonus game trigger | 0.5 | (※2) |
| JACKPOT 7 | 0.5 | 30 |
| BLUE 7 | 0.8 | 10 |
| BELL | 1.1 | 8 |
| STRAWBERRY | 1.5 | 5 |
| PLUM | 1.8 | 4 |
| CHERRY | 3.0 | 2 |
| ORANGE | 7.5 | 1 |

※1 Number of payouts per single inserted coin
※2 Bonus game is executed

GAMING SYSTEM COMPRISING A PLURALITY OF SLOT MACHINES AND METHOD FOR CONTROLLING GAMING MACHINE

CROSS-REFERENCE TO RELATED APPLICATIONS

This application claims benefit of priority based on U.S. Provisional Patent Application No. 61/031,176 filed on Feb. 25, 2008. The contents of this application are incorporated herein by reference in their entirety.

BACKGROUND OF THE INVENTION

1. Field of the Invention

The present invention relates to a gaming system comprising a plurality of slot machines and a method for controlling a gaming machine.

2. Discussion of the Background

Conventional gaming machines such as slot machines are structured such that, during slot games, when a player inserts any number of medals into a metal insertion port and operates a start button, a plurality of symbols are scrolling-displayed in partitioned areas along a plurality of columns and a plurality of rows in a display and then are stopped, and when symbols stopped along a preset pay line form an winning combination or when a predetermined number of scatter symbols are stopped, payout is performed according to the number of inserted coins, as described in, for example, US 2002/0025843-A1.

There are gaming systems including a plurality of slot machines as described above and being configured such that the number of medals inserted in the plurality of slot machines is partially accumulated, and when symbols forming a predetermined winning combination are stopped, the number of medals corresponding to the accumulated number of inserted medals are paid out, as a jackpot.

In such gaming systems, the respective individual slot machines determine whether or not jackpots should be generated, which has induced the problem of difficulty in causing players playing games in the respective slot machines to have feeling of playing games for acquiring the same jackpots.

Also, there are gaming systems including a plurality of gaming machines and a specific device connected to these gaming machines, wherein the specific device is adapted to accumulate partially the number of medals inserted in the plurality of gaming machines and to determine the number of medals to be paid out in the respective gaming machines, as disclosed in U.S. Pat. No. 6,224,484.

In such gaming systems, the aforementioned specific device determines the number of medals to be paid out in the respective gaming machines. In cases where the specific device determines payouts for the respective gaming machines as described above, the gaming machines connected to the specific device are machines dedicated to the specific device and cannot function as individual gaming machines, and further, the number of installed gaming machines is fixed, which have degraded the efficiency in some cases.

The present invention was made in view of the aforementioned problems and aims at providing a gaming system and a gaming-machine controlling method which enable efficient activation of gaming machines and also cause a plurality of players to have feeling of playing common games, thereby offering new entertainment characteristics.

The contents of US 2002/0025843-A1 and U.S. Pat. No. 6,224,484 are incorporated herein by reference in their entirety.

SUMMARY OF THE INVENTION

According to a first aspect of the present invention, there is provided a gaming system having the following configuration.

Namely, the aforementioned gaming system comprises a plurality of slot machines which can communicate with one another through communication lines, each slot machine comprising a main display and a sub display which are capable of arranging symbols thereon, and a controller programmed to execute processes of: (a) executing games in which symbols are rearranged on the main display; (b) changing symbols arranged on the sub display in such a way as to scroll symbols in a lateral direction in a display zone comprising sub displays in the respective slot machines, the sub displays being connected laterally to one another; (c) stopping changing of symbols in the process (b) at predetermined timing; and (d) providing an award on a basis of the symbol arranged on the sub display upon stopping the changing of symbols in the process (c).

According to the aforementioned gaming system, symbols on the respective sub displays are changed in such a way as to scroll symbols in the lateral direction (hereinafter, also referred to as lateral scrolling) in the display zone comprising the sub displays (for example, the upper image display panels) included in the respective slot machines, the sub displays being connected laterally to one another. Further, the changing of symbols in the sub displays (the lateral scrolling of symbols in the display zone) is stopped at predetermined timing, and awards are provided in the respective slot machines on the basis of the symbols arranged on the respective sub displays.

With the aforementioned system, games are executed using the display zone comprising the sub displays included in the respective slot machines, the sub displays being connected to one another. This causes players playing games in the respective slot machines forming the aforementioned gaming system to have feeling of playing common games.

Further, the lateral scrolling of symbols in the display zone is stopped at predetermined timing, and accordingly, the players cannot know when the lateral scrolling of symbols will be stopped. This can cause the players to have higher expectations for when the lateral scrolling will be stopped and awards will be provided. This can offer new entertainment characteristics.

Further, the display zone can be provided by connecting the sub displays included in the respective slot machines to one another, not by preliminarily providing an integrated common display. This enables executing common games in the plurality of slot machines using the display zone and also enables activating the respective slot machines individually. That is, by switching through software within the respective slot machines, common games can be executed in the plurality of slot machines, and also, the respective slot machines can be activated individually. This eliminates the necessity of using the respective slot machines as machines dedicated to games using the display zone, thereby enabling effective utilization of the bodies.

Desirably, the aforementioned gaming machine further includes the following configuration.

Namely, the process (b) is a process for changing symbols arranged on the sub display in such a way as to scroll symbols in the lateral direction in the display zone comprising the sub displays in the respective slot machines, the sub displays being connected laterally and imaginarily to one another.

In the gaming system, the display zone is formed from the sub displays in the respective slot machines, the sub displays being imaginarily connected to one another, for example, in such a way that they are arranged with predetermined gaps interposed therebetween.

Accordingly, it is possible to execute common games in the plurality of slot machines without physically connecting the sub displays to one another. This enables effective utilization of the bodies.

According to a second aspect of the present invention, there is provided a gaming system having the following configuration.

Namely, the aforementioned gaming system comprises a plurality of slot machines which can communicate with one another through communication lines, each slot machine comprising a main display and a sub display which are capable of arranging symbols thereon, and a controller programmed to execute processes of: (a) executing normal games in which symbols are rearranged on the main display; (b) executing special games, when symbols are rearranged in specific patterns on the main display during the normal games; (c) changing symbols arranged on the sub display in such a way as to scroll symbols in a lateral direction in a display zone comprising the sub displays in the respective slot machines, the sub displays being connected laterally to one another; (d) stopping the changing of symbols in the process (c) at predetermined timing; and (e) providing an award on a basis of the symbol arranged on the sub display upon stopping the changing of symbols in the process (d).

According to the gaming system, special games are executed, when symbols are rearranged in specific patterns during normal games. Further, symbols on the respective sub displays are changed in such a way as to scroll symbols in the lateral direction (hereinafter, also referred to as lateral scrolling) in the display zone comprising the sub displays (for example, the upper image display panels) included in the respective slot machines which are connected laterally to one another. Further, the changing of symbols in the sub displays (the lateral scrolling of symbols in the display zone) is stopped at predetermined timing, and awards are provided in the respective slot machines on the basis of the symbols arranged on the respective sub displays.

With the system, games are executed using the display zone comprising the sub displays included in the respective slot machines, the sub displays being connected to one another. This causes players playing games in the respective slot machines forming the aforementioned gaming system to have feeling of playing common games.

Further, the lateral scrolling of symbols in the display zone is stopped at predetermined timing, and accordingly, the players cannot know when the lateral scrolling of symbols will be stopped. This can cause the players to have higher expectations for when the lateral scrolling will be stopped and awards will be provided, namely for whether the lateral scrolling will be stopped during normal games or during special games. This can offer new entertainment characteristics.

Further, the display zone can be provided by connecting the sub displays included in the respective slot machines to one another, not by preliminarily providing an integrated common display. This enables executing common games in the plurality of slot machines using the display zone and also enables activating the respective slot machines individually. That is, by switching through software within the respective slot machines, common games can be executed in the plurality of slot machines, and also, the respective slot machines can be activated individually. This eliminates the necessity of using the respective slot machines as machines dedicated to games using the display zone, thereby enabling effective utilization of the bodies.

Desirably, the aforementioned gaming machine further includes the following configuration.

Namely, the process (c) is a process for changing symbols arranged on the sub display in such a way as to scroll symbols in the lateral direction in the display zone comprising the sub displays in the respective slot machines, the sub displays being connected laterally and imaginarily to one another.

In the gaming system, the display zone is formed from the sub displays in the respective slot machines, the sub displays being imaginarily connected to one another, for example, in such a way that they are arranged with predetermined gaps interposed therebetween.

Accordingly, it is possible to execute common games in the plurality of slot machines without physically connecting the sub displays to one another. This enables effective utilization of the bodies.

Desirably, the aforementioned gaming machine further includes the following configuration.

Namely, the process (d) is a process for stopping the changing of symbols in the process (c) at predetermined timing during normal games.

With the gaming system, the lateral scrolling of symbols in the display zone is stopped during normal games.

Accordingly, the lateral scrolling of symbols is suddenly stopped during normal games and awards are provided, which prevents normal games from becoming monotonous.

Desirably, the aforementioned gaming machine further includes the following configuration.

Namely, the process (d) is a process for stopping the changing of symbols in the process (c) at predetermined timing during special games.

With the aforementioned gaming system, lateral scrolling of symbols in the display zone is stopped during special games.

Accordingly, lateral scrolling of symbols is suddenly stopped during special games and awards are provided, which cause players to have higher expectations from the special game.

According to a third aspect of the present invention, there is provided a method for controlling gaming machines.

The aforementioned method for controlling gaming machines for use in a gaming system comprises a plurality of slot machines which can communicate with one another through communication lines, each slot machine comprising a main display and a sub display which are capable of arranging symbols thereon, and a controller, the method comprising the steps of: (a) causing the controller to execute games in which symbols are rearranged on the main display; (b) causing the controller to change symbols arranged on the sub display in such a way as to scroll symbols in a lateral direction in a display zone comprising the sub displays in the respective slot machines, the sub displays being connected laterally to one another; (c) causing the controller to stop the changing of symbols in the step (b) at predetermined timing; and (d) causing the controller to provide an award on the basis of the symbol arranged on the sub display upon stopping the changing of symbols in the step (c).

According to the gaming-machine controlling method, symbols on the respective sub displays are changed in such a way as to scroll symbols in the lateral direction (hereinafter, also referred to as lateral scrolling) in the display zone comprising the sub displays (for example, the upper image display panels) included in the respective slot machines, the sub displays being connected laterally to one another. Further, the changing of symbols in the sub displays (the lateral scrolling of symbols in the display zone) is stopped at predetermined timing, and awards are provided in the respective slot machines on the basis of the symbols arranged on the respective sub displays.

With the system, games are executed using the display zone comprising the sub displays included in the respective slot machines, the sub displays being connected to one another. This causes players playing games in the respective slot machines forming the gaming system to have feeling of playing common games.

Further, the lateral scrolling of symbols in the display zone is stopped at predetermined timing, and accordingly, the players cannot know when the lateral scrolling of symbols will be stopped. This can cause the players to have higher expectations for when the lateral scrolling will be stopped and awards will be provided. This can offer new entertainment characteristics.

Further, the display zone can be provided by connecting the sub displays included in the respective slot machines to one another, not by preliminarily providing an integrated common display. This enables executing common games in the plurality of slot machines using the display zone and also enables activating the respective slot machines individually. That is, by switching through software within the respective slot machines, common games can be executed in the plurality of slot machines, and also, the respective slot machines can be activated individually. This eliminates the necessity of using the respective slot machines as machines dedicated to games using the display zone, thereby enabling effective utilization of the bodies.

Desirably, the aforementioned method for controlling gaming machines includes the following configuration.

Namely, the step (b) is a step of causing the controller to change symbols arranged on the sub display in such a way as to scroll symbols in the lateral direction in the display zone comprising the sub displays in the respective slot machines, the sub displays being connected laterally and imaginarily to one another.

In the gaming-machine controlling method, the aforementioned display zone is formed from the sub displays in the respective slot machines, the sub displays being imaginarily connected to one another, for example, in such a way that they are arranged with predetermined gaps interposed therebetween.

Accordingly, it is possible to execute common games in the plurality of slot machines without physically connecting the sub displays to one another. This enables effective utilization of the bodies.

BRIEF DESCRIPTION OF THE DRAWINGS

FIG. 4 is a schematic view illustrating symbol sequences which are displayed in the respective display blocks.

FIG. 10 is a view illustrating the relationship between a plurality of types of prizes and the number of coin-outs.

DESCRIPTION OF THE EMBODIMENTS

First Embodiment

An embodiment of the present invention will be described, on the basis of the drawings.

Figure 1:
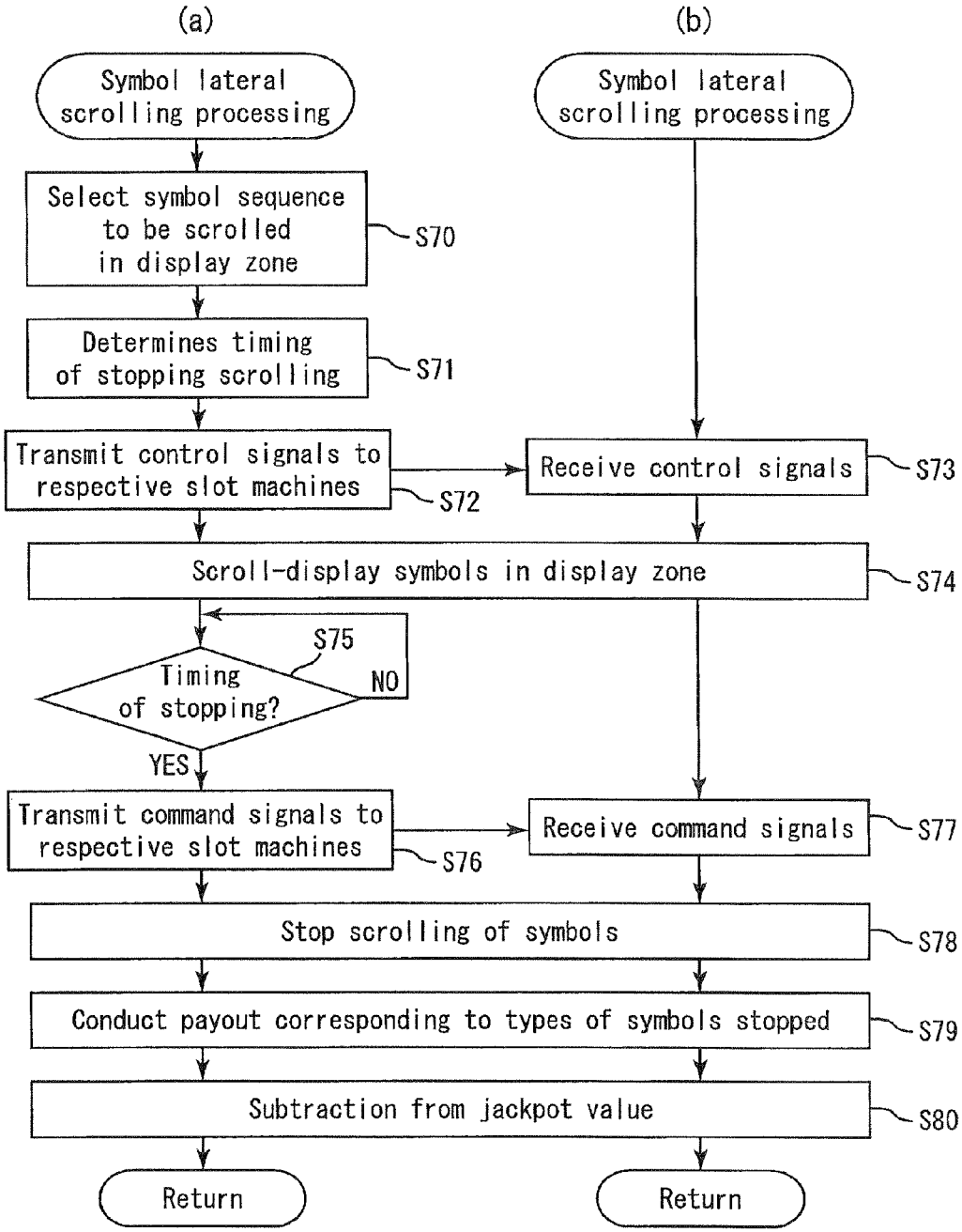
FIG. 1 is a flow chart illustrating symbol lateral scrolling processing which is executed in slot machines according to a first embodiment of the present invention.
Figure 2:
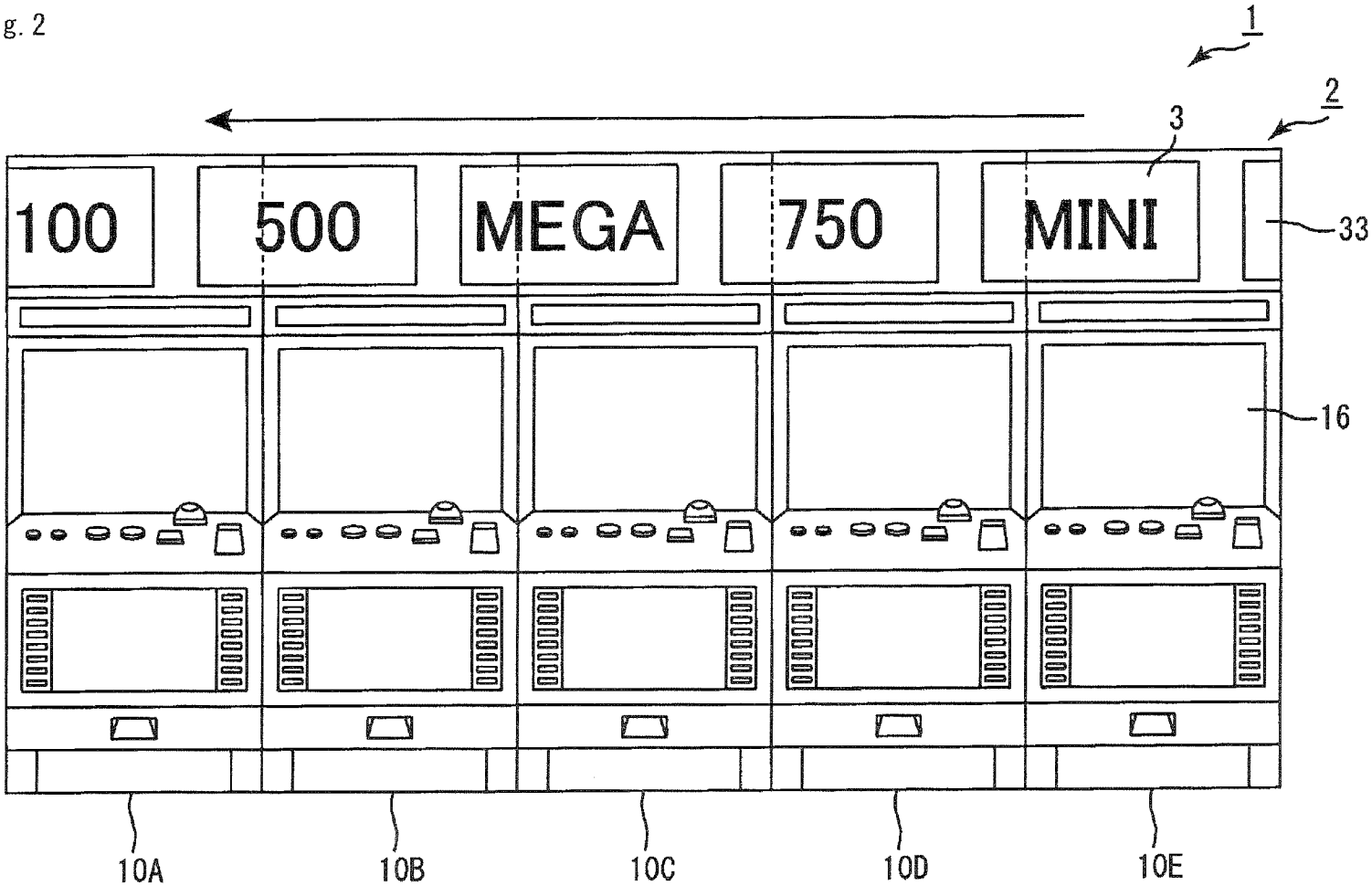
FIG. 2 is a schematic view illustrating the entire structure of a gaming system according to the first embodiment of the present invention.

FIG. 1 is a flow chart illustrating symbol lateral scrolling processing which is executed in slot machines according to a first embodiment of the present invention. FIG. 2 is a schematic view illustrating the entire structure of a gaming system according to the first embodiment of the present invention.

As illustrated in FIG. 2, a gaming system 1 according to the first embodiment includes five slot machines 10 (slot machines 10A to 10E).

The symbol lateral scrolling processing is processing which is called up and executed in game execution processing (see FIG. 6) executed in the slot machines 10 forming the gaming system 1 and also is processing for laterally scrolling symbols 3 (scrolling symbols in the leftward or rightward direction) in a display zone 2 (see FIG. 2) comprising upper image display panels 33 included in the respective slot machines 10, the upper image display panels 33 being connected to one another.

The reference character (a) illustrates symbol lateral scrolling processing which is executed by a predetermined single slot machine 10 (the slot machine 10A illustrated in FIG. 2, in the present embodiment).

The reference character (b) illustrates symbol lateral scrolling processing which is executed by the slot machines 10 (the slot machines 10B to 10E illustrated in FIG. 2, in the present embodiment) other than the slot machine 10 which executes the aforementioned processing (a).

First, in step S70 in (a), a main CPU 41 in the slot machine 10A selects a symbol sequence to be scrolled in the display zone 2.

A plurality of types of symbol sequences are stored in a ROM 42, and in step S70, the main CPU 41 selects a single symbol sequence, out of the plurality of types of symbol sequences. Also, in step S70, a predetermined number of symbols may be selected out of a plurality of symbols to create a symbol sequence.

Next, in step S71, the main CPU 41 in the slot machine 10A determines the timing of stopping the lateral scrolling of symbols 3 in the display zone 2. More specifically, the main CPU 41 selects a single stop timing, out of a plurality of stop timings, such as after the elapse of 30 seconds and 1 minute, from the start of scrolling, using random numbers.

Next, in step S72, the main CPU 41 in the slot machine 10A transmits control signals to the respective slot machines 10 (the slot machines 10B to 10E). The control signals include data for controlling the timing of starting lateral scrolling of symbols 3 and data for identifying the symbol sequence.

Next, in step S73 in (b), the main CPUs 41 in the slot machines 10B to 10E receive the control signals from the slot machine 10A. This enables the slot machines 10 which execute the processing (b) (the slot machines 10B to 10E) to perform scrolling display of the same symbol sequence and to stop the scrolling, at timing synchronized with that in the slot machine 10 which executes the processing (a) (the slot machine 10A).

Next, in step S74 in (a) and (b), the main CPUs 41 in the slot machines 10A to 10E execute processing for scroll-displaying symbols 3 in the display zone 2.

That is, the respective main CPUs 41 properly change the display of symbols 3 on the upper image display panels 33 included in the respective slot machines 10, in such a manner that each symbol 3 is scrolled in the display zone 2 in the right-to-left direction, as illustrated in FIG. 2.

The slot machines 10 adjacent to one another execute the processing in step S74, which causes symbols 3 to be scroll-displayed in the single continuous display zone 2.

Next, in step S75 in (a), the main CPU 41 in the slot machine 10A determines whether or not the timing of stopping the lateral scrolling of symbols 3 in the display zone 2 has come. When the main CPU 41 determines that the timing of stopping the lateral scrolling has not come, it returns the processing to step S75.

On the other hand, when the main CPU 41 determines that the timing of stopping the lateral scrolling has come, in step S76 in (a), the main CPU 41 in the slot machine 10A transmits command signals to the respective slot machines 10 (the slot machines 10B to 10E). The command signals include signals indicative of commands for stopping of the lateral scrolling of symbols 3.

Next, in step S78 in (a) and (b), the main CPUs 41 in the slot machines 10A to 10E stop the lateral scrolling of symbols 3 in the display zone 2. That is, the respective main CPUs 41 stop changing symbols 3 in the upper image display panels 33 included in the respective slot machine 10.

Next, at a step S79 in (a) and (b), the main CPUs 41 in the slot machines 10A to 10E determine the types of the symbols 3 stopped in the upper image display panels 33 in the respective slot machines 10 and conducts a payout corresponding to the types. More specifically, when any symbols 3 out of "100", "500" and "750" are stopped in the upper image display panels 33, the number of coins corresponding to the number indicated by the respective numeric characters is paid out. When "MEGA" is stopped, the number of coins corresponding to 50% of jackpots to be described later is paid out. When "MINI" is stopped, the number of coins corresponding to 10% of jackpots is paid out.

Next, in step S80 in (a) and (b), each of the main CPUs 41 in the slot machines 10A to 10E subtracts the number of credits corresponding to the number of coins paid out in step S79 from a jackpot value stored in a RAM 43.

After the execution of the processing in step S80, the present subroutine ends.

FIG. 2 is a schematic view illustrating the entire structure of the gaming system according to the first embodiment of the present invention. The gaming system 1 includes a plurality of slot machines 10 (five slot machines in the present embodiment) (10A to 10E). The respective slot machines 10 are interconnected through cables (not illustrated).

Each slot machine 10 includes an upper image display panel 33 at its upper portion and also includes a lower image display panel 16 at its lower portion. The lower image display panel 16 corresponds to a main display according to the present invention. The upper image display panel 33 corresponds to a sub display according to the present invention. There is no particular limitation on the positions of the main display and the sub display.

Each slot machine 10 rearranges symbols arranged in the lower image display panel 16 and determines a prize on the basis of the rearranged symbols. Further, each slot machine 10 also rearranges symbols on the upper image display panel 33.

The rearranging of symbols on the upper image display panels 33 is performed in the single continuous display zone 2, as illustrated in FIG. 2. The display zone 2 is comprising the upper image display panels 33 in the plurality of slot machines 10 (10A to 10E), the upper image display panels 33 being connected to one another. On the respective upper image display panels 33, the display of symbols is changed so that a plurality of symbols are laterally scrolled in the display zone 2.

More specifically, in FIG. 2, five symbols 3 of "100", "500", "MEGA", "750" and "MINI" are displayed in the display zone 2, wherein these symbols 3 are scrolled in the lateral direction (the direction of an arrow in the figure). For example, the symbol 3 of "MINI" is being displayed on the display 10E, and thereafter, it will be displayed on the displays 10D, 100, 10B and 10A in the mentioned order and then will be displayed on the display 10E, again.

After the start of scrolling display of symbols in the display zone 2, when a predetermined stop timing comes, symbols are stop-displayed in the respective upper image display panels 33. The respective symbols 3 determine the number of coins to be paid out in the respective slot machines 10.

The symbols 3 of "100", "500" and "750" indicate the number of coins to be paid out.

Further, "MINI" causes payout of the number of coins corresponding to 10% of the jackpot value. Further, "MEGA" causes payout of the number of coins corresponding to 50% of the jackpot value. The symbols are not limited to alphanumeric characters as described above, but may be, for example, pictures indicative of trains and the like.

Next, the structure of the slot machines 10 will be described.

Figure 3:
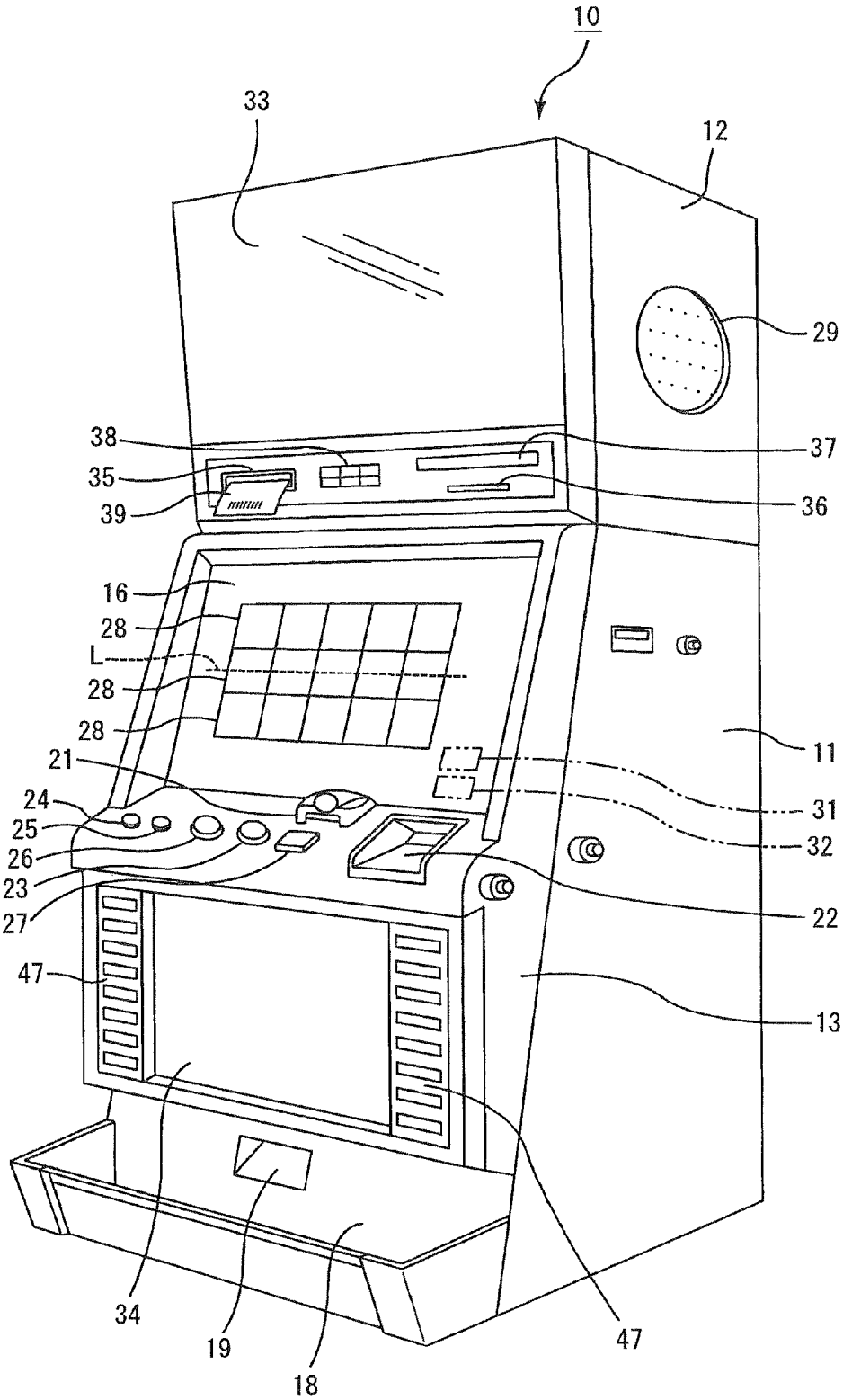
FIG. 3 is a perspective view illustrating the external appearance of a slot machine which is a constituent of the gaming system illustrated in FIG. 2.

FIG. 3 is a perspective view illustrating the external appearance of a slot machine which is a constituent of the gaming system illustrated in FIG. 2.

The slot machine 10 employs coins, bills, or electronic valuable information corresponding to coins or bills, as game media. However, in the present invention, there is no particular limitation on game media, and game media can be, for example, medals, tokens, electronic money and tickets. Further, there is no particular limitation on the tickets, and the tickets can be, for example, bar-coded tickets as will be described later, and the like.

The slot machine 10 includes a cabinet 11, a top box 12 installed on the cabinet 11, and a main door 13 provided in the front surface of the cabinet 11.

In the main door 13, there is provided the lower image display panel 16 as a display. The lower image display panel 16 includes a transparent liquid crystal display panel which displays 15 display blocks 28 along 5 columns and 3 rows. A single symbol is displayed in each display block 28.

Further, a number-of-credits display portion 31 and a number-of-payouts display portion 32 are provided in the lower image display panel 16. The number-of-credits display portion 31 displays an image indicative of the number of coins being credited. The number-of-payouts display portion 32 displays an image indicative of the number of coin-outs.

Further, a touch panel 69, which is not illustrated, is provided in the front surface of the lower image display panel 16, which enables a player to input various types of commands by operating the touch panel 69.

Below the lower image display panel 16, there are provided a control panel 20 comprising a plurality of buttons 23 to 27 which enable the player to input commands relating to the progress of games, a coin reception port 21 which receives coins and introduces them to the inside of the cabinet 11, and a bill validator 22.

On the control panel 20, there are provided a spin button 23, a change button 24, a cash-out button 25, a 1-BET button 26 and a max-BET button 27. The spin button 23 is for inputting a command for starting scrolling of symbols. The change button 24 is used for making a request to personnel of the recreation facility for change. The cash-out button 25 is for inputting a command for payout of credited coins into a coin tray 18.

The 1-BET button 26 is for inputting a command for betting, on games, a single coin out of the credited coins. The max-BET button 27 is for inputting a command for betting, on games, the maximum number of coins which can be betted on a single game (50 coins, in the present embodiment), out of credited coins.

The 1-BET button 26 and the max-BET button 27 correspond to an input device according to the present invention.

The bill validator 22 determines whether bills are valid or invalid and receives valid bills and introduces them to the inside of the cabinet 11. Also, the bill validator 22 may be structured to be capable of reading bar-coded tickets 39 as will be described later.

In the front surface of the lower portion of the main door 13, there is provided a belly glass 34 on which various types of images relating to slot games in the slot machine 10 are displayed. Such images can be, for example, characters of the slot machine 10 and the like.

Lamps 47 are provided on the opposite sides of the belly glass 34 and are lighted on the basis of predetermined lighting patterns during games executed in the slot machine 10. Below the belly glass 34, there are provided a payout port 19 for ejecting coins to be paid out, and a coin tray 18 for accumulating the coins paid out.

Further, speakers 29 are provided in the side portions of the top box 12, and the upper image display panel 33 is provided in the front surface of the top box 12. The upper image display panel 33 includes a liquid crystal display panel which displays various types of images such as character images relating to games. The upper image display panel 33 also displays symbols in conjunction with the other slot machines 10, as illustrated in FIG. 2. The upper image display panel 33 employed herein has no frame at its screen periphery, in order to display images without inducing gaps between these images (symbols) displayed in this upper image display panel 33 and images (symbols) displayed in the upper image display panels 33 in the adjacent slot machines 10.

Below the upper image display panel 33, there are provided a ticket printer 35, a card reader 36, a data display device 37 and a key pad 38. The ticket printer 35 prints, on a ticket, a bar-code created by coding data of the number of credits, the date and time, the identification number of the slot machine 10, and the like, and outputs it as a bar-coded ticket 39. The player can cause another slot machine to read the bar-coded ticket 39 for playing games in this slot machine or can change the bar-coded ticket 39 to bills and the like at a predetermined location in the recreation facility (for example, a cashier in a casino).

The card reader 36 reads and writes data from and to a smart card. Such a smart card is a card carried by a player and stores, for example, data for identifying the player and data about the history of games which have been played by the player. Such a smart card may store data corresponding to coins, bills or credits. Also, instead of a smart card, it is possible to employ a magnetic stripe card. The data display device 37 comprises, for example, a fluorescent display, and displays, for example, data read through the card reader 36 and data inputted through the key pad 38 by the player. The key pad 38 is for inputting commands and data relating to issuing tickets and the like.

FIG. 4 is a schematic view illustrating symbol sequences which are displayed in the respective display blocks.

As described above, the lower image display panel 16 displays 15 display blocks 28 along 5 rows and 3 columns, and each display block 28 displays a single symbol.

As illustrated in FIG. 4, five sequences of symbols made of the total of 22 symbols having code Nos. "00" to "21" are scrolled along the five symbol columns of the respective display blocks 28. Each symbol sequence comprises a combination of symbols "JACKPOT 7", "BLUE 7", "BELL", "STRAWBERRY", "PLUM", "CHERRY", "ORANGE" and "APPLE".

When five symbols of "JACKPOT 7", "BLUE 7", "BELL", "STRAWBERRY", "PLUM", "CHERRY" or "ORANGE" are stop-displayed along a winning line L, a predetermined number of coins are paid out (see FIG. 10).

"APPLEs" are a bonus game trigger (symbols which cause a transition to bonus games). When five "APPLEs" are displayed along the winning line L, this will cause the transition to bonus games.

After the 1-BET button 26 or the max-BET button 27 is pushed, when the spin button 23 is pushed to start games, symbols are scroll-displayed in the respective display blocks 28 in the direction from the upper side to the lower side. Further, after the elapse of a predetermined time, symbols are stop-displayed. Further, various types of prizes are predetermined in association with the respective combinations of symbols (see FIG. 10), and when a combination of symbols corresponding to a prize is stopped along the winning line L, the number of coin-outs corresponding to the prize is added to the credits owned by the player. Further, when a bonus game trigger is established, bonus games will be generated.

Further, while, in the present embodiment, there has been described a case where symbols displayed in the display blocks 28 are automatically stop-displayed after the elapse of a predetermined time from the start of scroll-displaying of symbols, there is no particular limitation on the condition required for causing symbols to be stopped, in the present invention. For example, a stop button may be provided in the slot machine 10, and symbols may be stop-displayed when the aforementioned stop button is pushed.

Figure 5:
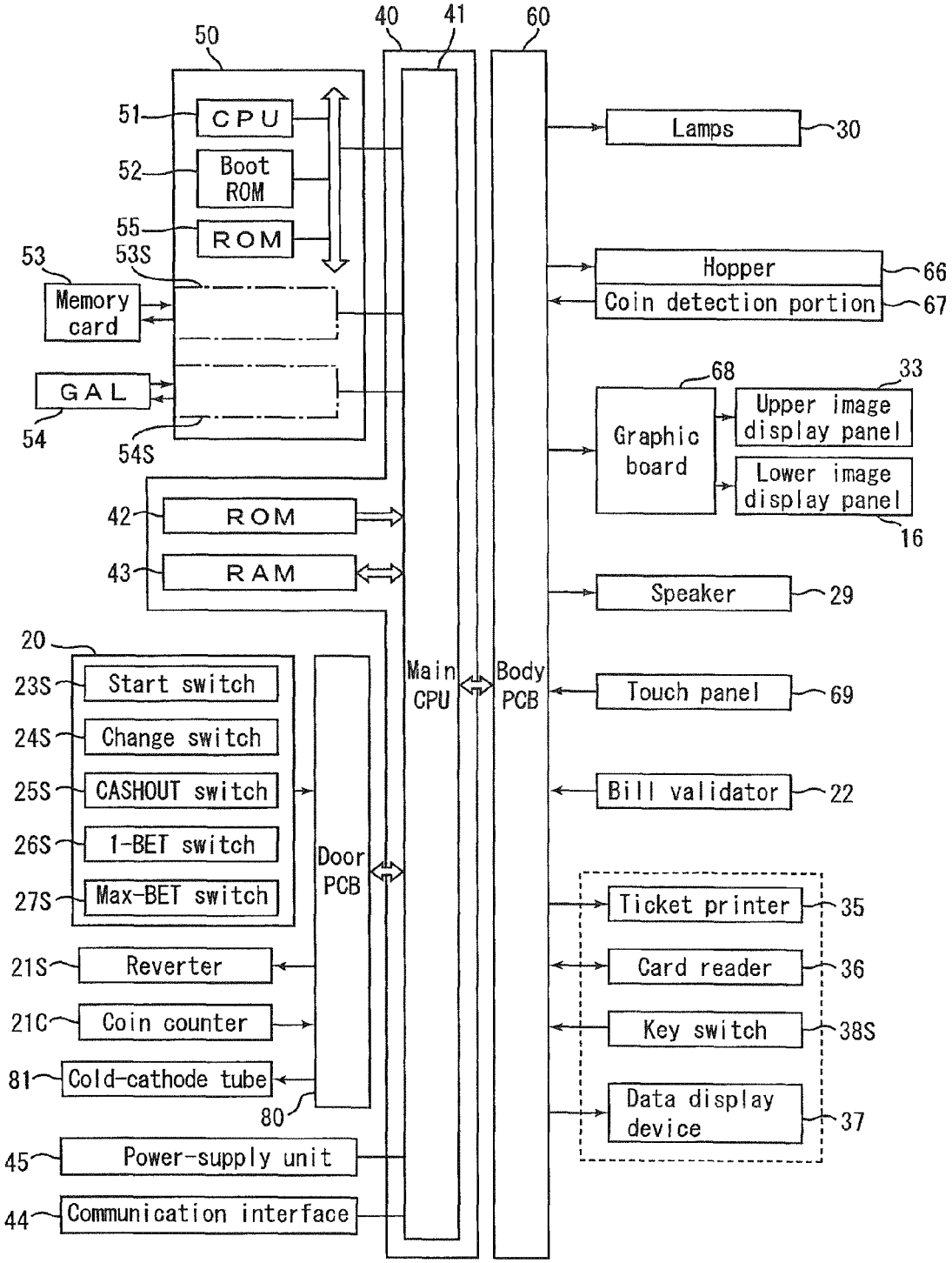
FIG. 5 is a block diagram illustrating the internal structure of the slot machine illustrated in FIG. 3.

FIG. 5 is a block diagram illustrating the internal structure of the slot machine illustrated in FIG. 3.

A gaming board 50 includes a CPU (Central Processing Unit) 51, a ROM 55 and a boot ROM 52 which are interconnected through an internal bus, a card slot 53S adaptable to a memory card 53, and an IC socket 54S adaptable to a GAL (Generic Array Logic) 54.

The memory card 53 comprises a nonvolatile memory such as Compact Flash (trademark) and stores game programs. The game programs include a symbol determination program. The symbol determination program is a program for determining symbols (code Nos. corresponding to symbols) to be rearranged in the display blocks 28.

Further, the card slot 53S is structured to enable the memory card 53 to be inserted thereinto and pulled out therefrom and also is connected to a mother board 40 through an IDE bus. Accordingly, it is possible to change the types and the contents of games to be executed by the slot machine 10 by pulling out the memory card 53 from the card slot 53S, writing different game programs into the memory card 53 and inserting the memory card 53 into the card slot 53S. The game programs include programs relating to the progress of games. Further, the game programs include image data and sound data to be output during games.

The CPU 51, the ROM 55 and the boot ROM 52 which are interconnected through the internal bus are connected to the mother board 40 through a PCI bus. The PCI bus transfers signals between the mother board 40 and the gaming board 50 and also supplies electricity from the mother board 40 to the gaming board 50.

The mother board 40 comprises a commercially-available common mother board (a printed circuit board on which fundamental components of a personal computer are mounted), and includes the main CPU 41, a ROM (Read Only Memory) 42, a RAM (Random Access Memory) 43 and a communication interface 44. The mother board 40 corresponds to a controller according to the present invention.

The ROM 42 is configured by a memory device such as a flash memory and stores programs such as a BIOS (Basic Input/Output System) to be executed by the main CPU 41 and also stores permanent data. When the main CPU 41 executes the BIOS, the BIOS executes processing for initializing predetermined peripheral devices and starts processing for introducing game programs stored in the memory card 53 through the gaming board 50. Further, in the present invention, the ROM 42 may be either rewritable or non-rewritable.

Further, the ROM 42 stores data indicative of a plurality of types of symbol sequences to be scrolling-displayed in the display zone 2.

The RAM 43 stores data and programs to be used in operating the main CPU 41. Further, the RAM 43 can store game programs.

Further, the RAM 43 stores the number of credits and data about the number of inserted coins and the number of coin-outs for a single game, and the like. Further, the RAM 43 stores a jackpot value indicative of jackpots obtained by accumulatively storing some of credits which have been betted on games.

Further, a main body PCB (Printed Circuit Board) 60 and a door PCB 80 to be described later are connected to the mother board 40 through the respective USBs. Further, a power-supply unit 45 and a communication interface 44 are connected to the mother board 40. The plurality of slot machines 10 forming the gaming system 1 are capable of communicating with the other slot machines 10 through the communication interface 44.

Apparatuses and devices which generate input signals to be inputted to the main CPU 41 and apparatuses and devices to be controlled in operation through control signals output from the main CPU 41 are connected to the main body PCB 60 and the door PCB 80. The main CPU 41 executes predetermined calculation processing and stores the result thereof in the RAM 43 and also transmits control signals to the respective apparatuses and devices as processing for controlling the respective apparatuses and devices, by executing game programs stored in the RAM 43 on the basis of input signals inputted to the main CPU 41.

Lamps 30, a hopper 66, a coin detection portion 67, a graphic board 68, the speakers 29, the touch panel 69, the bill validator 22, the ticket printer 35, the card reader 36, the key switch 38S and the data display device 37 are connected to the main body PCB 60. The lamps 30 are lighted in predetermined patterns, on the basis of control signals output from the main CPU 41.

The hopper 66 is installed within the cabinet 11 and pays out a predetermined number of coins to the coin tray 18 through the coin payout port 19, on the basis of control signals output from the main CPU 41. The coin detection portion 67 is provided inside the coin payout port 19 and outputs input signals to the main CPU 41 on detecting a predetermined number of coins being paid out from the coin payout port 19.

The graphic board 68 controls the display of images on the upper image display panel 33 and the lower image display panel 16, on the basis of control signals output from the main CPU 41. The lower image display panel 16 displays, in the respective display blocks 28, a background color determined through selection of random numbers and symbols being scrolled or stopped. The number-of-credits display portion 31 in the lower image display panel 16 displays the number of credits stored in the RAM 43. Further, the number-of-payouts display portion 31 in the lower image display panel 16 displays the number of coin-outs.

The graphic board 68 includes a VDP (Video Display Processor) for creating image data on the basis of control signals output from the main CPU 41, and a video RAM for temporarily storing the image data created by the VDP, and the like. Further, such image data for use in creating image data through the VDP is included in game programs which have been read from the memory card 53 and stored in the RAM 43.

The bill validator 22 determines whether bills are valid or invalid and receives valid bills and introduces them to the inside of the cabinet 11. The bill validator 22, on receiving valid bills, outputs an input signal to the main CPU 41, on the basis of the value of the bills. The main CPU 41 stores, in the RAM 43, the number of credits corresponding to the value of bills transferred through the input signals.

On the basis of control signals output from the main CPU 41, the ticket printer 35 prints, on a ticket, a bar-code created by coding the number of credits stored in the RAM 43 and data about the date and time and the identification number of the slot machine 10 and the like, and outputs it as a bar-coded ticket 39.

The card reader 36 reads data from a smart card and transmits it to the main CPU 41 and also writes data into a smart card on the basis of control signals from the main CPU 41. The key switch 38S, which is provided on the key pad 38, outputs predetermined input signals to the main CPU 41 when the player operates the key pad 38. The data display device 37 displays data read through the card reader 36 and data inputted through the key pad 38 by the player, on the basis of control signals output from the main CPU 41.

The control panel 20, a reverter 21S, a coin counter 21C and a cold-cathode tube 81 are connected to the door PCB 80. On the control panel 20, there are provided a spin switch 23S associated with a spin button 23, a change switch 24S associated with the change button 24, a CASHOUT switch 25S associated with the cash-out button 25, a 1-BET switch 26S associated with the 1-BET button 26, and a max-BET switch 27S associated with the max-BET button 27. The respective switches 23S to 27S output input signals to the main CPU 41, when the player operates the corresponding buttons 23 to 27.

The coin counter 21C is provided inside the coin receiving port 21 and determines whether coins inserted into the coin receiving port 21 by the player are valid or invalid. Objects other than valid coins are ejected from the coin payout port 19. Further, the coin counter 21C outputs input signals to the main CPU 41, on detecting valid coins.

The reverter 21S operates on the basis of control signals output from the main CPU 41 and distributes coins determined to be valid coins by the coin counter 21C to a cash box (not illustrated) and the hopper 66 installed inside the slot machine 10. That is, when the hopper 66 is filled with coins, the reverter 21S supplies valid coins to the cash box. On the other hand, when the hopper 66 is not filled with coins, valid coins are supplied to the hopper 66. The cold-cathode tube 81 functions as back lights installed near the back surfaces of the lower image display panel 16 and the upper image display panel 33 and is lighted on the basis of control signals output from the main CPU 41.

Next, there will be described processing which is conducted in the slot machine 10.

The main CPU 41 reads and executes game programs to carry forward games.

Figure 6:
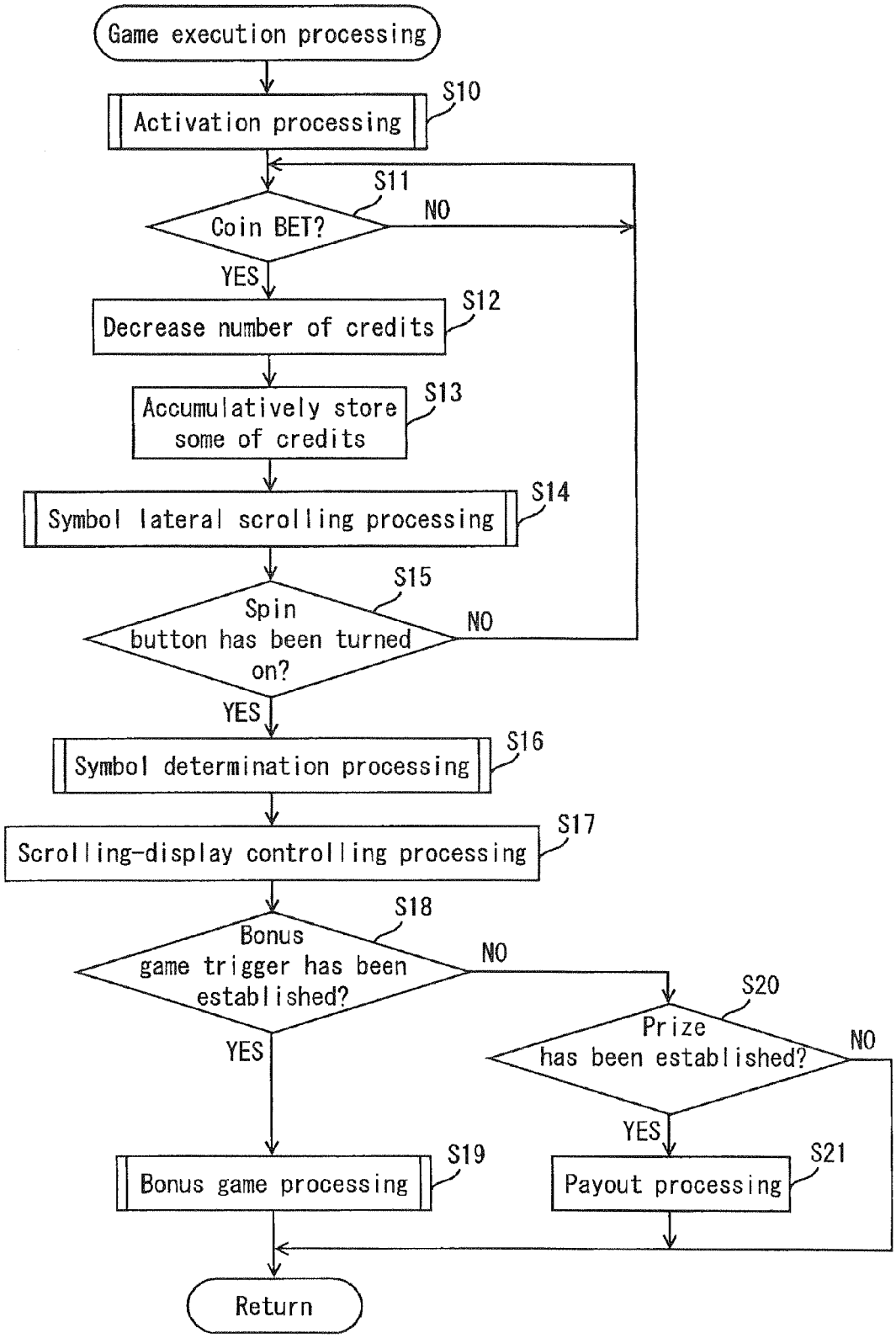
FIG. 6 is a flow chart illustrating a subroutine of game execution processing.

FIG. 6 is a flow chart illustrating a subroutine of game execution processing.

First, the main CPU 41 executes activation processing with the mother board 40 and the gaming board 50 (step S10). The activation processing will be described later in more detail, with reference to FIG. 7 and FIG. 8.

Next, the main CPU 41 determines whether or not coins have been betted (step S11). In this processing, the main CPU 41 determines whether or not it has received an input signal output from the 1-BET switch 26S when the 1-BET button 26 is operated or an input signal output from the max-BET switch 27S when the max-BET button 27 is operated. When the main CPU 41 determines that no coin has been betted, it returns the processing to step S11.

On the other hand, when the main CPU 41 determines in step S11 that coins have been betted, the main CPU 41 executes processing for decreasing the number of credits stored in the RAM 43, according to the number of betted coins (step S12). Further, when the number of betted coins is larger than the number of credits stored in the RAM 43, the processing is returned to step S11, without executing the processing for decreasing the number of credits stored in the RAM 43. Further, when the number of betted coins exceeds an upper limit value of coins which can be betted on a single game (50 coins, in the present embodiment), the processing is carried forward to step S14, without executing the processing for decreasing the number of credits stored in the RAM 43.

Next, in step S13, the main CPU 41 adds the number of credits corresponding to some (10%) of the betted coins to the jackpot value stored in the RAM 43.

At this time, the main CPU 41 transmits, to the other slot machines 10, request signals for requesting addition of some of the number of betted credits to the jackpot value, through the communication interface 44.

On the other hand, in the slot machines 10 which have received the request signals, the main CPUs 41 update the jackpot value stored in the RAM 43 on the basis of the request signals. This enables the slot machines 10 forming the gaming system 1 to share the jackpot value.

When any of the slot machines 10 performs payout of jackpots, all the slot machines 10 forming the gaming system 1 decrease the jackpot value, by an amount corresponding to this payout.

Next, in step S14, the main CPU 41 executes processing for laterally scrolling symbols in the display zone 2. The symbol lateral scrolling processing has been already described with reference to FIG. 1 and will not be described herein.

Note that in the symbol lateral scrolling processing, when lateral scrolling of symbols 3 in the display zone 2 is started, the present game execution processing is shifted to step S15. Thereafter, the game execution processing and the symbol lateral scrolling processing are executed in parallel, until the completion of games.

Next, in step S15, the main CPU 41 determines whether or not the spin button 23 has been turned on. In this processing, the main CPU 41 determines whether or not it has received an input signal which is output from the spin switch 23S when the spin button 23 is pressed. When it is determined that the spin button 23 has not been turned on, the processing is returned to step S11. Note that when the spin button 23 has not been turned on (for example, when a request for ending games is inputted without turning on the spin button 23), the main CPU 41 cancels the result of the subtraction in step S12 and also cancels the jackpot-value addition processing in step S13.

On the other hand, when it is determined in step S15 that the spin button 23 has been turned on, the main CPU 41 executes symbol determination processing (step S16). In this symbol determination processing, the main CPU 41 executes the symbol determination program stored in the RAM 43 to determine the code Nos. of symbols to be stopped at the time of stoppage of symbols. Thus, a combination of symbols to be stop-displayed is determined. This processing will be described later in more detail, with reference to FIG. 9 and FIG. 10. While, in the present embodiment, there will be described a case where a combination of symbols to be stop-displayed is determined to determine a single prize out of a plurality of types of prizes, a single prize to be selected out of a plurality of types of prize may be determined first, and then, a combination of symbols to be stop-displayed may be determined on the basis of the prize, in the present invention.

Next, the main CPU 41 executes scrolling-display controlling processing (step S17). This processing is processing for starting scrolling display of symbols, and thereafter, stopping the scrolling display in the respective display blocks 28 in such a way as to rearrange, along the winning line L, the combination of symbols corresponding to the prize determined in step S16.

Next, in step S18, the main CPU 41 determines whether or not a bonus game trigger has been established, namely whether or not five "APPLEs" have been rearranged along the winning line L. When the main CPU 41 determines that a bonus game trigger has been established, the main CPU 41 reads a program for executing bonus games from the RAM 43 and then executes bonus-game processing (step S19). The bonus-game processing will be described later in more detail, with reference to FIG. 11.

On the other hand, when the main CPU 41 determines that no bonus trigger has been established, the main CPU 41 determines whether or not a prize has been established (step S20). When the main CPU 41 determines that a prize has been established, the main CPU 41 performs coin-out, according to the number of inserted coins and the prize (step S21).

In the case where coins are accumulated, the main CPU 41 performs processing for adding the number of credits corresponding to the number of coins to the number of credits stored in the RAM 43. On the other hand, in the case where coins are paid out, the main CPU 41 transmits control signals to the hopper 66 to cause it to perform payout of a predetermined number of coins.

When the processing in step S19 or S21 has been executed or when it is determined in step S20 that no prize has been established (when no-winning has occurred), the present subroutine ends.

Figure 7:
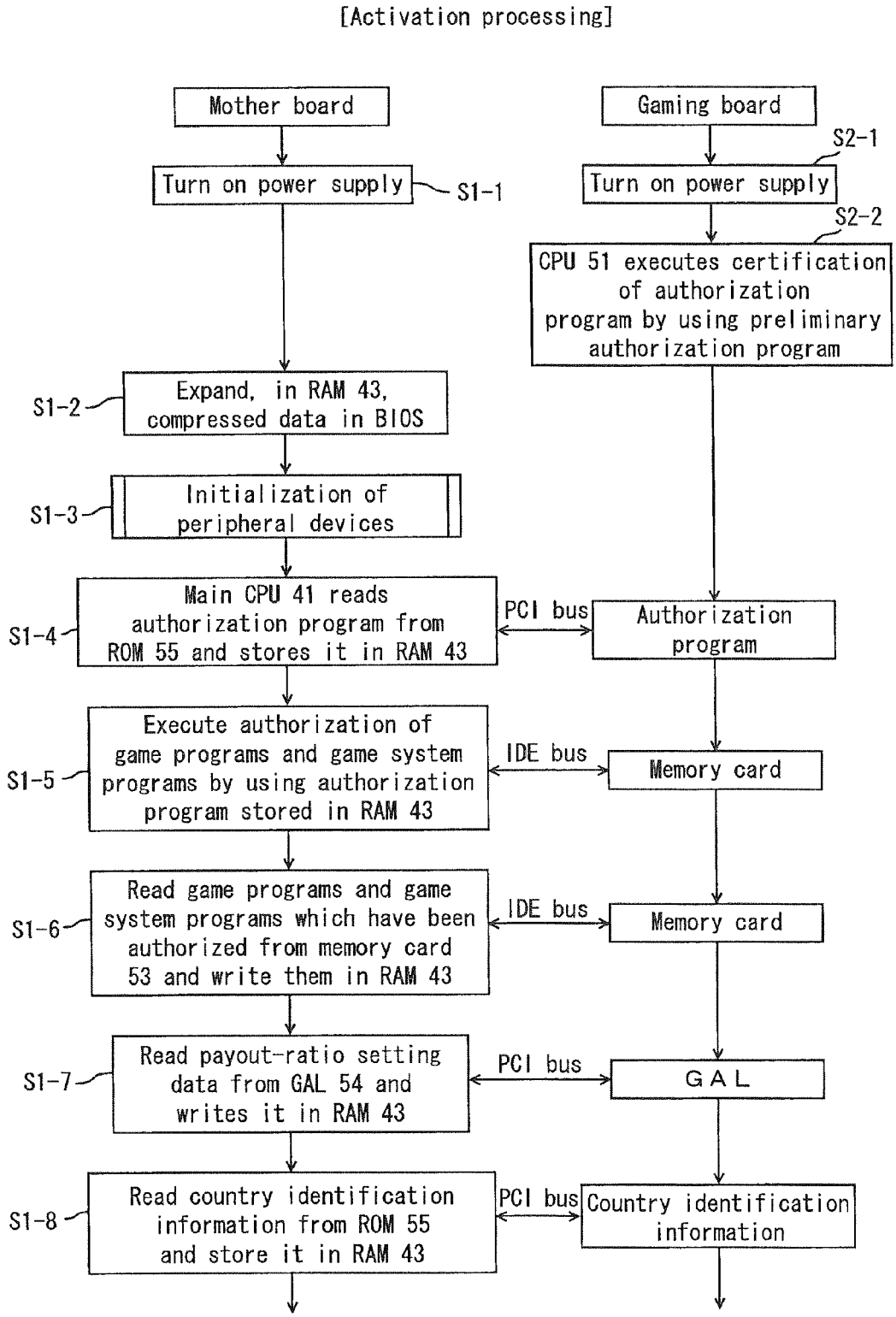
FIG. 7 is a flow chart illustrating the procedures of activation processing which are executed by a mother board and a gaming board.

FIG. 7 is a flow chart illustrating the procedures of the activation processing which is called up and executed in step S10 in FIG. 6. This activation processing is processing which is executed by the mother board 40 and the gaming board 50. Note that it is assumed that a memory card 53 is inserted in the card slot 53S in the gaming board 50, and a GAL 54 is mounted to the IC socket 54S.

First, when a power-supply switch in a power-supply unit 45 is turned on (the power supply is turned on), the mother board 40 and the gaming board 50 are activated (steps S1-1 and S2-1). After the activation of the mother board 40 and the gaming board 50, different processes are executed in parallel. That is, in the gaming board 50, the CPU 51 reads a preliminary authorization program stored in the boot ROM 52 and performs preliminary authorization for preliminarily confirming and certifying that no falsification has been made in an authorization program, before it is introduced into the mother board 40, according to the read preliminary authorization program (step S2-2). On the other hand, in the mother board 40, the main CPU 41 executes the BIOS stored in the ROM 42 to expand, in the RAM 43, compressed data incorporated in the BIOS (step S1-2). Then, the main CPU 41 executes the BIOS expanded in the RAM 43 and performs diagnoses and initialization of various types of peripheral devices (step S1-3). The processing in step S1-3 will be described later in more detail, with reference to FIG. 8.

Then, the main CPU 41 executes processing for reading the authorization program stored in the ROM 55 and storing the read authorization program in the RAM 43, since the ROM 55 in the gaming board 50 is connected to the main CPU 41 through a PCI bus (step S1-4). At this time, the main CPU 41 follows a function of standard BIOS of BIOS, stores the authorization program in the RAM 43, while executing processing for checking whether or not the storage can be performed without failures, using check sum according to an ADDSUM system (standard checking function).

Next, the main CPU 41 accesses the memory card 53 inserted in the card slot 53S through the IDE bus, after checking what is connected to the IDE bus, and then reads game programs and gaming system programs from the memory card 53. In this case, the main CPU 41 reads the data contained in the game programs and the gaming system programs, on a 4-bytes-by-4-bytes basis. Then, the main CPU 41 performs authorization for confirming and certifying that no falsification has been made in the game programs and the gaming system programs which have been read, according to the authentication program stored in the RAM 43 (step S1-5). After this authorization processing is normally completed, the main CPU 41 writes and stores, in the RAM 43, the game programs and the gaming system programs which has been subjected to the authorization (which have been authorized) (step S1-6). Next, the main CPU 41 accesses the GAL 54 mounted to the IC socket 54S through the PCI bus, then reads payout-ratio setting data from the GAL 54 and writes and stores it in the RAM 43 (step S1-7). Next, through the PCI bus, the main CPU 41 executes processing for reading country identification information stored in the ROM 55 in the gaming board 50 and storing the read country identification information in the RAM 43 (step S1-8).

After executing the aforementioned processing, the main CPU 41 successively reads and executes the game programs and the gaming system programs to execute the game execution processing.

Figure 8:
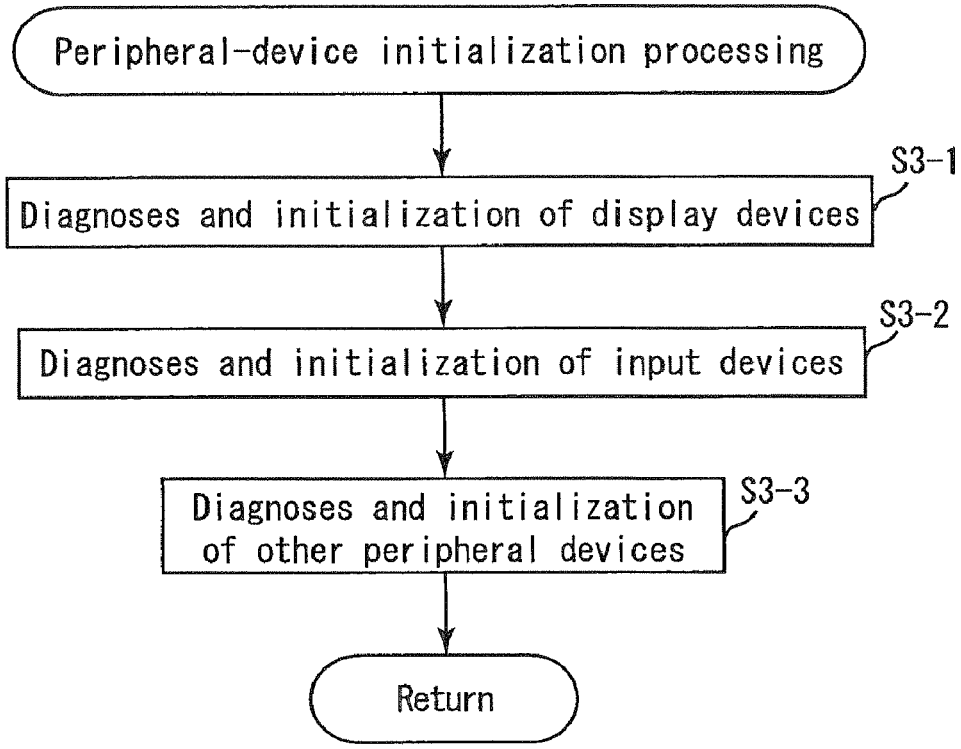
FIG. 8 is a flow chart illustrating the procedures of peripheral-device initialization processing.

FIG. 8 is a view illustrating peripheral-device initialization processing.

First, the main CPU 41 performs diagnoses and initialization of the display devices (step S3-1). In this processing, the main CPU 41 transmits a request signal to the graphic board 68, then determines whether or not it has received a predetermined replay signal therefrom and also performs clearing of predetermined storage areas, and the like.

Next, the main CPU 41 performs diagnoses and initialization of various types of input devices (step S3-2). In this processing, the main CPU 41 transmits request signals to the input devices such as the start switch 23S, the change switch 24S, the CASHOUT switch 25S, the 1-BET switch 26S, the max-BET switch 27S and the touch panel 11, and then, determines whether or not it has received predetermined replay signals therefrom.

Next, the main CPU 41 performs diagnoses and initialization of the other peripheral devices connected to the main CPU 41 (step S3-3). Thereafter, the present subroutine ends.

Figure 9:
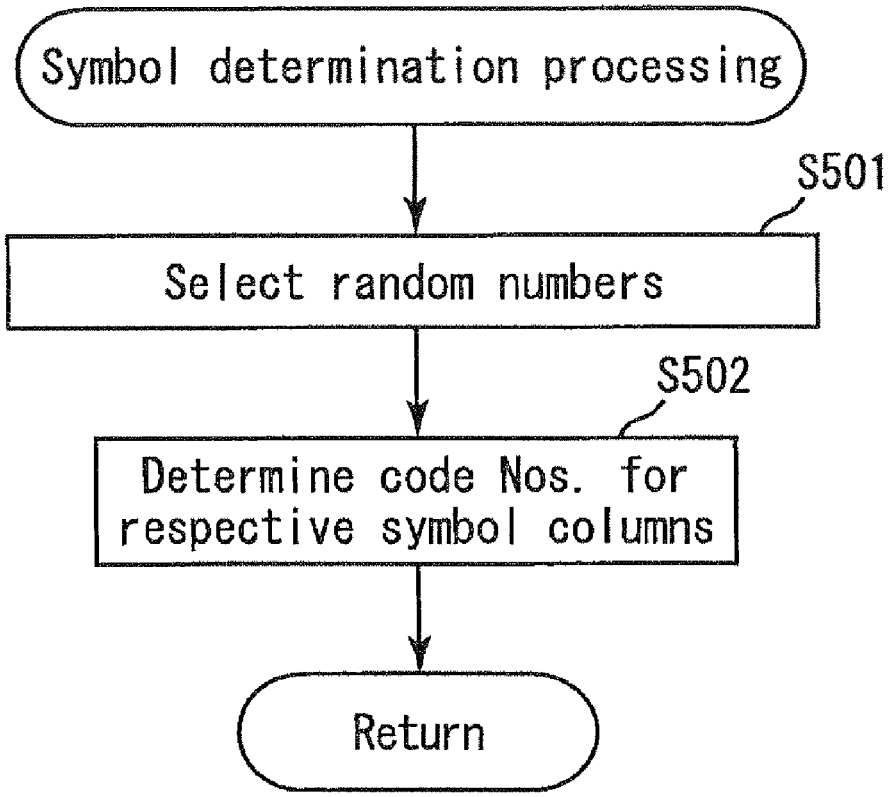
FIG. 9 is a flow chart illustrating a subroutine of symbol determination processing.

FIG. 9 is a flow chart illustrating a subroutine of the symbol determination processing which is called up and executed in step S16 in the subroutine illustrated in FIG. 6. This processing is processing which the main CPU 41 executes by executing the symbol determination program stored in the RAM 43.

First, the main CPU 41 selects random numbers for the respective symbol sequences, out of the numerical range of 0 to 255, by executing a random-number generation program included in the symbol determination program (step S501). In the present embodiment, there will be described a case where random numbers are generated through a program (so-called software random numbers are used). However, in the present invention, a random number generating circuit may be provided, and random numbers may be extracted from this random number generating circuit (so-called hardware random numbers may be used).

Next, the main CPU 41 determines code Nos. for the respective symbol columns (see FIG. 4), on the basis of the selected five random numbers (step S502). The code Nos. for the symbol columns correspond to the code Nos. of symbols to be rearranged in the display blocks 28 in the second row, out of the display blocks 28 arranged in the three rows. The main CPU 41 determines a prize, by determining code Nos. for the respective symbol columns.

Hereinafter, prizes according to the present embodiment will be described.

FIG. 10 is a view illustrating the relationship between a plurality of types of prizes and the number of coin-outs.

When five symbols of "APPLE" are stop-displayed along the winning line L to cause winning of a bonus game trigger, this will generate bonus games. In bonus games, a predetermined number of free games are executed, on the basis of random numbers obtained from execution of the random-number generation program included in the symbol determination program.

When five symbols of "JACKPOT 7" are stop-displayed along the winning line L, 30 coins per a single inserted coin will be paid out. Similarly, when five symbols of "BLUE 7", "BELL", "STRAWBERRY", "PLUM", "CHERRY" or "ORANGE" are stop-displayed along the winning line L, the number of coins corresponding to the prize for the corresponding combination are paid out.

Figure 11:
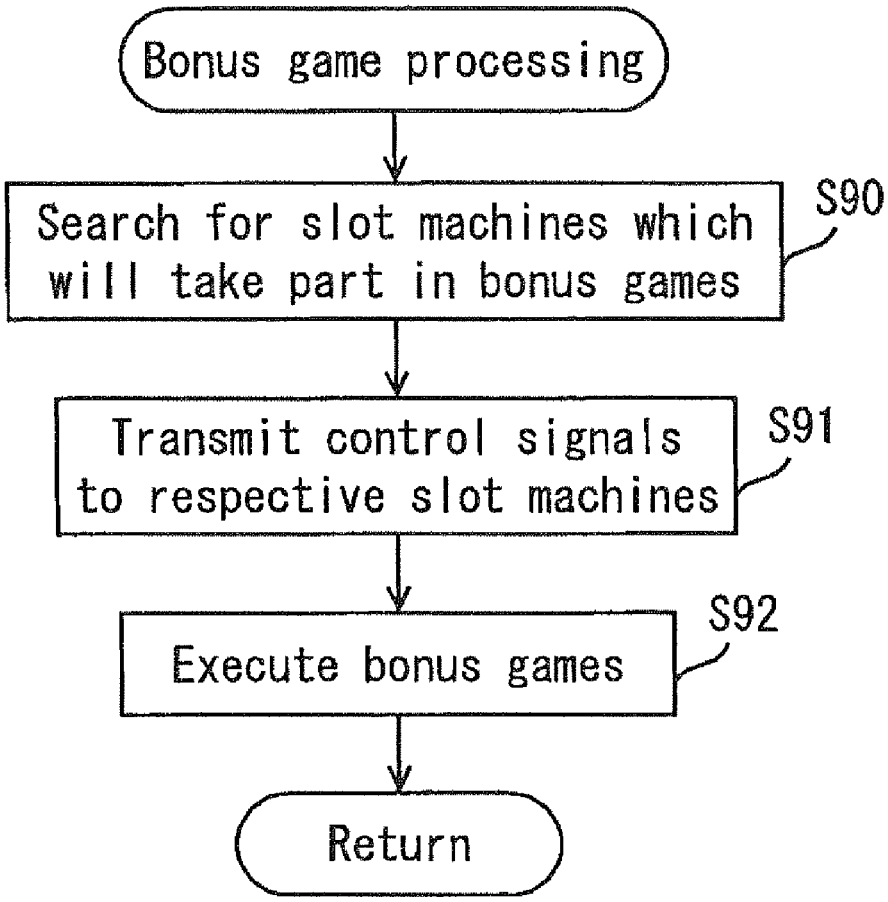
FIG. 11 is a flow chart illustrating a subroutine of bonus game processing.

FIG. 11 is a flowchart illustrating a subroutine of bonus game processing which is called up and executed in step S19 in FIG. 6.

First, in step S90, the main CPU 41 searches for slot machines 10 which will take part in bonus games, out of the slot machines 10 forming the gaming system 1.

There is no particular limitation on slot machines which will take part in bonus games. Slot machines which will take part in bonus games can be, for example, slot machines being activated, a predetermined number of slot machines adjacent to one another, all the slot machines structured to be communicable through a network, and the like.

Next, in step S91, the main CPU 41 transmits control signals to the respective slot machines 10 which will take part in bonus games. The control signals include data for use in controlling the timing of starting bonus games.

On receiving the control signals, the slot machines 10 start bonus games at timing synchronized with that in the slot machine 10 which transmitted the control signals.

Next, in step S92, the main CPU 41 executes bonus games.

There is no particular limitation on the types of bonus games, and such bonus games may be, for example, free games which the player may play without consuming game media such as coins or games which may cause payout of greater numbers of coins than those in normal games (games other than bonus games). In the present embodiment, there will be described a case where bonus games are free games.

Bonus games correspond to special games according to the present invention.

Further, while, in the present embodiment, there will be described a case where a plurality of slot machines 10 execute bonus games in common, individual slot machines 10 may execute bonus games separately from one another, in the present invention.

After the execution of the processing in step S92, the present subroutine ends.

Figure 12:
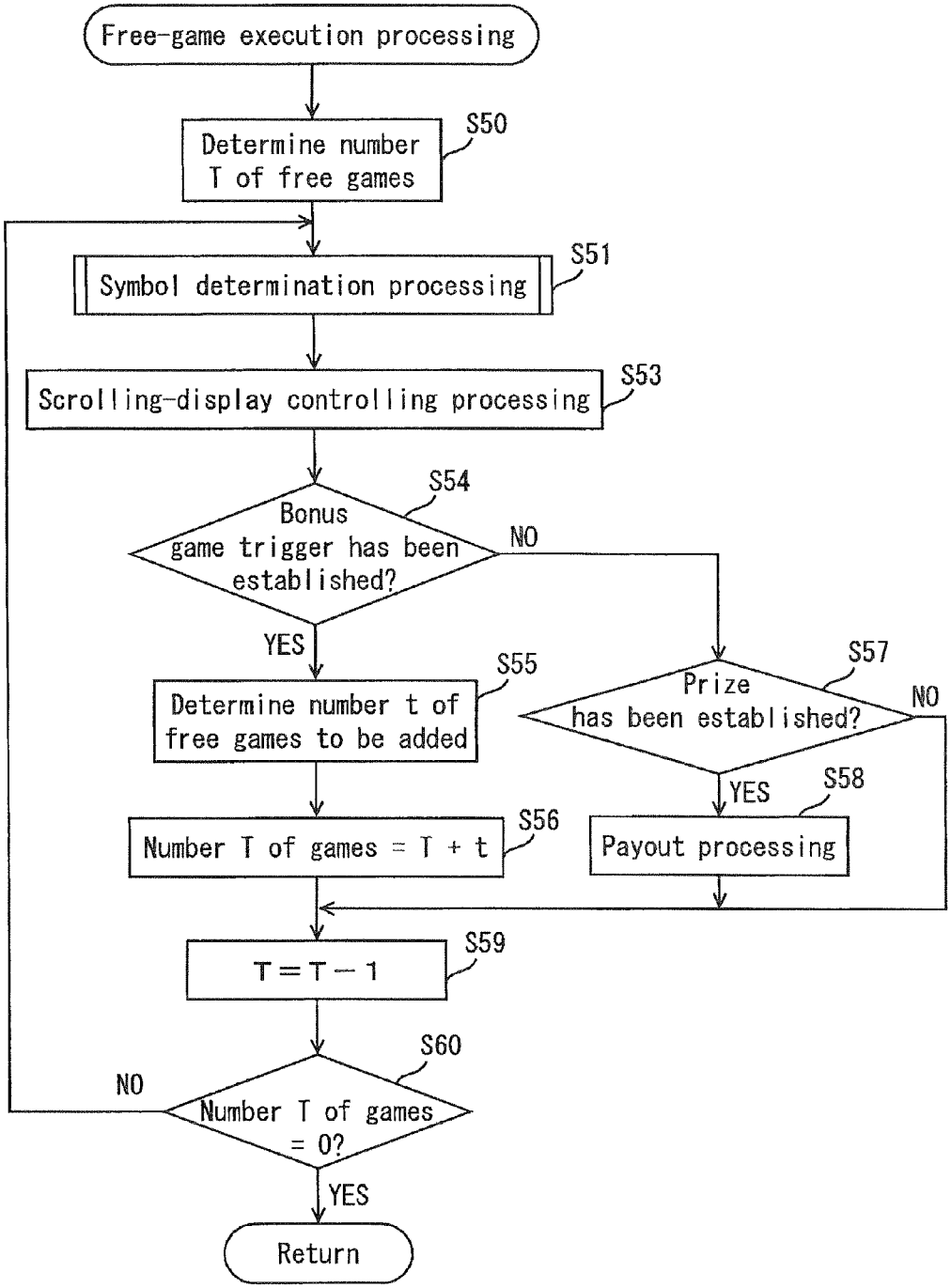
FIG. 12 is a flow chart illustrating a subroutine of free-game execution processing.

FIG. 12 is a flow chart illustrating a subroutine of free-game execution processing.

The free-game execution processing is processing which is executed in cases where bonus games in step S92 in FIG. 11 are free games.

First, the main CPU 41 determines the number of free games, out of 10 to 25 games, on the basis of random number values obtained from execution of the random-number generation program included in the symbol determination program stored in the RAM 43 (step S50). The main CPU 41 stores the determined number of free games as data in the RAM 43.

Subsequently, the main CPU 41 executes symbol determination processing (step S51) and scrolling-display controlling processing (step S53). The processing in step S51 is substantially the same processing as the processing described with reference to FIG. 9. This processing has been already described and will not be described herein.

Next, the main CPU 41 determines whether or not a bonus game trigger has been established, namely whether or not five "APPLEs" have been stop-displayed along the winning line L (step S54). When the main CPU 41 determines that a bonus game trigger has been established, the main CPU 41 determines a new number t of free games to be repeated (step S55) and adds the determined number t of free games to be repeated to the current number T of free games (step S56). Thus, in the event of the occurrence of winning of a bonus game during bonus games, the number of remaining free games is increased. More specifically, for example, after transition to 20 free games for the first time, in the event of the occurrence of winning of 17 free games during the 12-th free game, then 25 (20−12+17) free games will be executed thereafter.

When no bonus game trigger has been established, the main CPU 41 determines whether or not a prize has been established (step S57). When the main CPU 41 determines that a prize has been established, the main CPU 41 performs coin-outs according to the number of inserted coins and the prize (step S58).

When the processing in step S56 or S58 has been executed or when it is determined in step S57 that no prize has been established (when it is determined that no winning has occurred), the main CPU 41 reads the number T of free games stored in the RAM 43 and subtracts 1 from the read number T of games. Then, the main CPU 41 stores, in the RAM 43, the number T of games after the subtraction, again (step S59).

Next, the main CPU 41 determines whether or not the number T of free games has reached the number of free games determined in step S50 (step S60). More specifically, the main CPU 41 determines whether or not the number T of games stored in the RAM 43 has reached 0. When the number T of games has not reached 0, namely when it is determined that the number of executed free games has not reached the number of games determined in step S50, the main CPU 41 returns the processing to step S51 and repeats the aforementioned processing. On the other hand, when the number T of games has reached 0, namely when it is determined that the number of games determined in step S50 has been reached, the present subroutine ends.

While, in the first embodiment, there has been described a case where one of the plurality of slot machines 10 performs determination of the timing of starting scrolling of symbols 3 in the display zone 2, determination of symbol sequences and controlling of the timing of starting bonus games, the present invention is not limited to the case. For example, a plurality of slot machines 10 may be connected to a server. Such a case will be described hereinafter.

Second Embodiment

In the second embodiment, components corresponding to those of the gaming system 1 according to the first embodiment will be designated by the same reference characters in the description.

Figure 13:
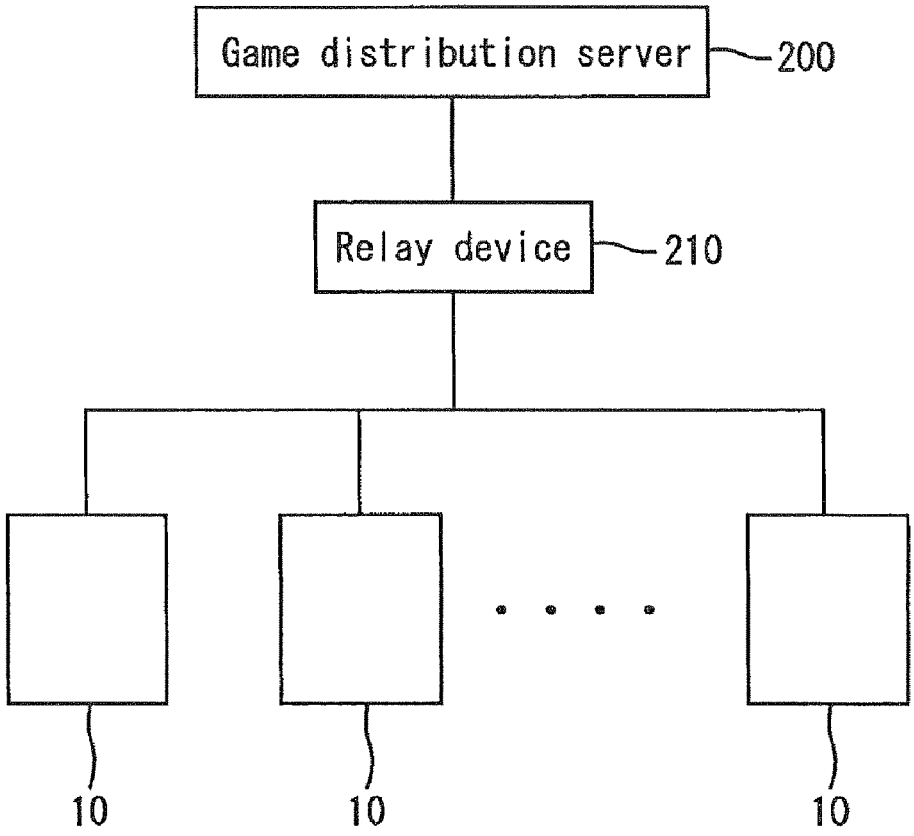
FIG. 13 is a network connection diagram of a gaming system according to a second embodiment of the present invention.

FIG. 13 is a network connection diagram of a gaming system according to the second embodiment of the present invention.

As illustrated in FIG. 13, a plurality of slot machines 10 are connected to a game distribution server 200 through a relay device 210. In this case, the game distribution server 200 performs, for example, storing and managing of a jackpot value (the step S80 and the like in FIG. 1) and also executes various types of processes for determining the content of processing for laterally scrolling symbols in the display zone 2, and the like. Further, on the basis of the results of such various types of processes, the game distribution server 200 transmits control signals to the respective slot machines 10 (the processing in steps S70 to S72 in FIG. 1, and the like).

On the basis of the control signals received from the game distribution server 200, the respective slot machines 10 perform scrolling display of symbols 3 in the display zone 2, stopping of the scrolling, offering payouts according to stopped symbols (the processing in steps S74 to S80 and the like, in FIG. 1) and the like.

Controllers provided inside the respective slot machines 10 illustrated in FIG. 13 and various types of apparatuses connected to the controllers have the same structures as those illustrated in FIG. 5 and are connected to the relay device 210 and the game distribution server 200 illustrated in FIG. 13, through the communication interface 44 illustrated in FIG. 5.

Figure 14:
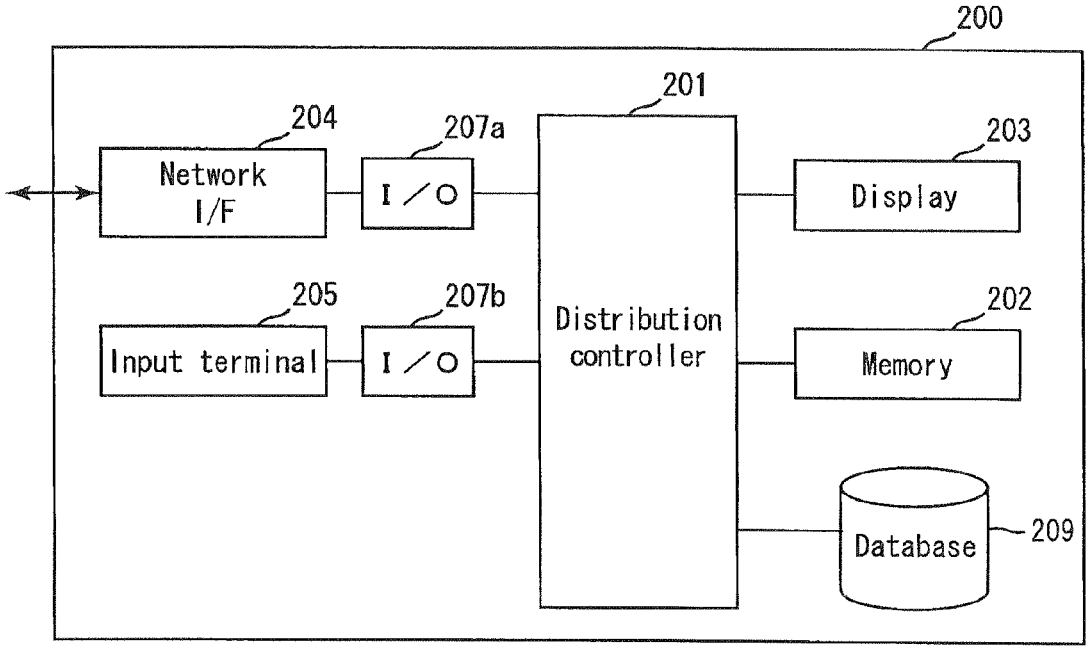
FIG. 14 is a block diagram illustrating the internal structure of a game distribution server according to the second embodiment of the present invention.

FIG. 14 is a block diagram illustrating the internal structure of the game distribution server according to the second embodiment of the present invention.

As illustrated in FIG. 14, the game distribution server 200 includes a distribution controller 201. A memory 202, a database 209 and a display 203 are connected to the distribution controller 201.

The database 209 stores a program for executing processing for laterally scrolling symbols in the display zone 2.

This program includes image data of symbols, image data forming backgrounds of symbols, and the like.

Further, input/output ports 207*a* and 207*b* are connected to the distribution controller 201, and the input/output port 207*a*, out of them, is connected to a network interface 204, while the input/output port 207*b* is connected to an input terminal 205. The game distribution server 200 can communicate with the respective slot machines 10 illustrated in FIG. 13, through the network interface 204.

A manager of the game distribution server 200 can set specifications of the processing for laterally scrolling symbols in the display zone 2, using the input terminal 205.

There is no particular limitation on specifications of the symbol lateral scrolling processing, and such specifications can be, for example, the symbol sequences, the scrolling speed, and the like. The input terminal 205 can be either a keyboard, a mouse, a track ball, or other operation switches. Further, the network interface 204 can be either a wired network interface, a wireless network interface or an interface including both of them. The game distribution server 200 includes a firewall (not illustrated), so that the firewall intercepts unauthorized accesses to programs within the game distribution server 200.

Figure 15:
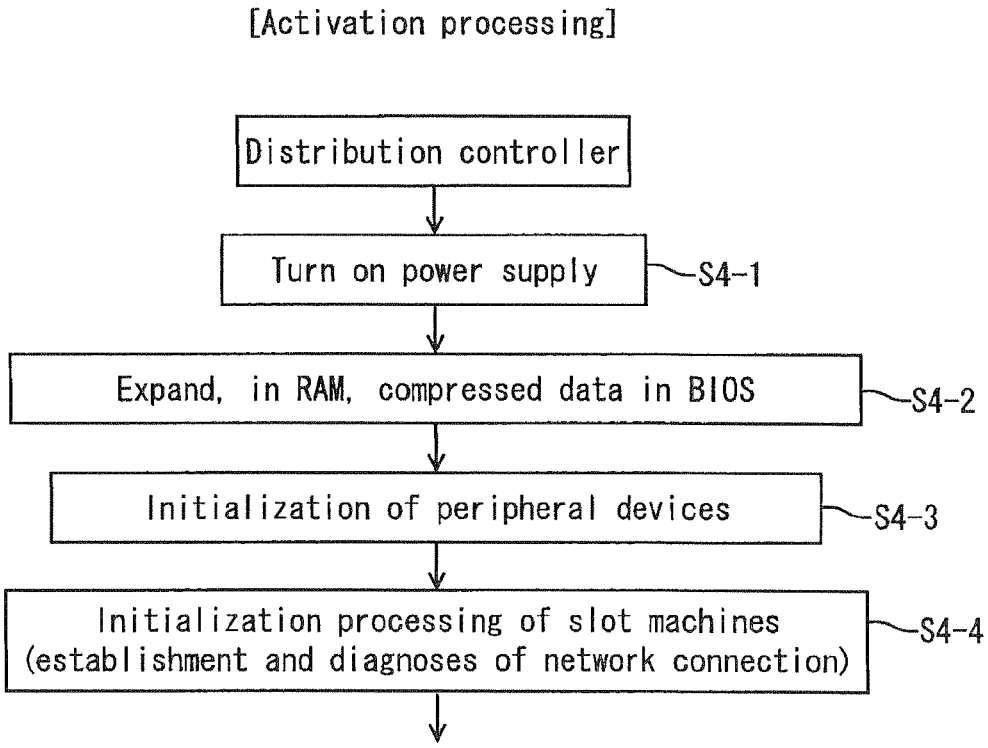
FIG. 15 is a flow chart illustrating a subroutine of activation processing which is executed by a distribution controller.

FIG. 15 is a flow chart illustrating a subroutine of activation processing which is executed by the distribution controller.

First, when a power-supply switch in a power-supply unit is turned on (the power supply is turned on), a mother board is activated (step S4-1).

In the mother board, a CPU executes a BIOS stored in a ROM to expand, in a RAM, compressed data incorporated in the BIOS (step S4-2). Then, the CPU executes the BIOS expanded in the RAM and performs diagnoses and initialization of various types of peripheral devices such as display devices (step S4-3).

Next, the CPU executes processing for initializing the respective slot machines. In this processing, the CPU establishes connection between the distribution controller and the respective slot machines 10 through a network and also performs diagnoses for checking whether or not the network functions normally.

After executing the aforementioned processing, the CPU reads and executes a game control program to control the progress of games being executed in the plurality of slot machines 10.

Next, there will be described procedures of processing for downloading, to a slot machine 10, game programs relating to symbol lateral scrolling processing which are distributed from the game distribution server 200.

Figure 16:
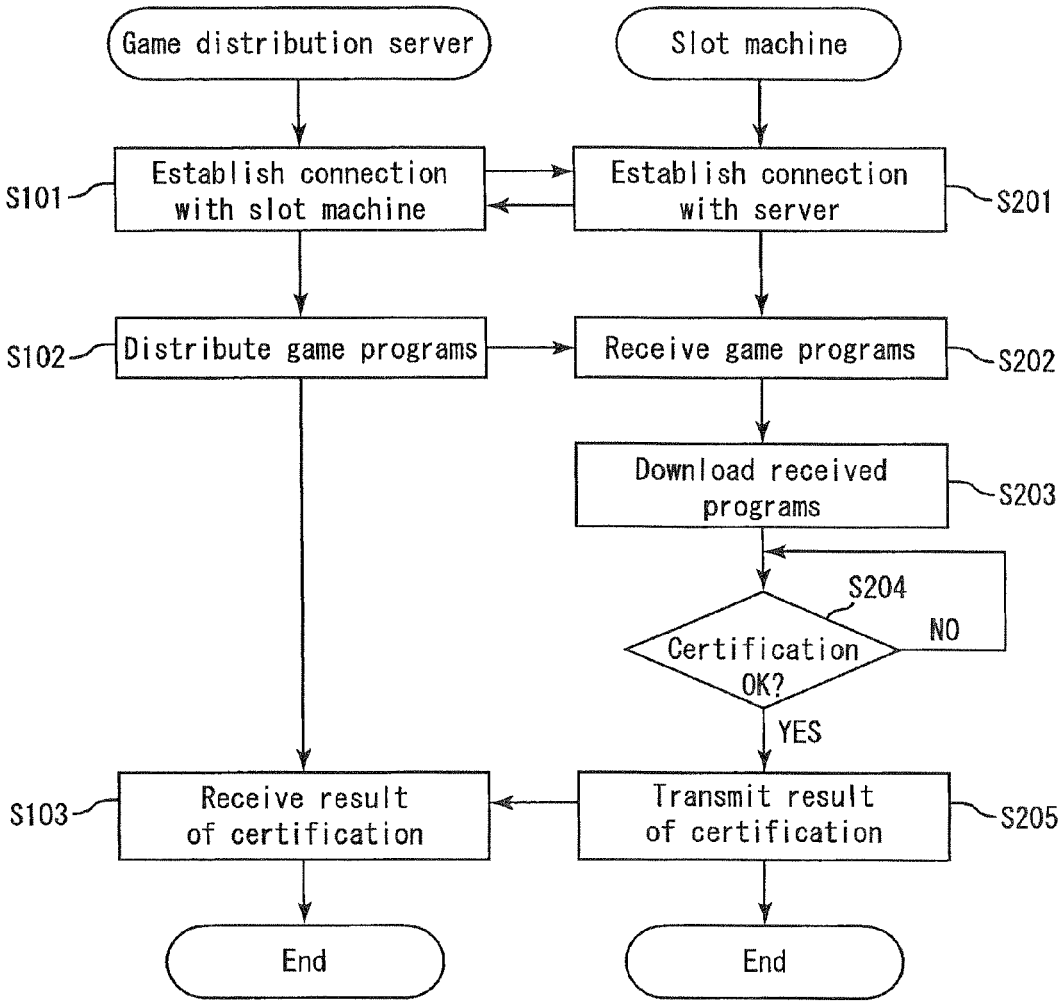
FIG. 16 is a flow chart illustrating the procedures for data transmission between a slot machine and a game distribution server, according to the second embodiment of the present invention.

FIG. 16 is a flow chart illustrating the procedures for data transmission between the slot machine and the game distribution server, according to the second embodiment of the present invention.

First, the slot machine 10 outputs a connection request to the game distribution server 200. The game distribution server 200 performs authorization confirmation on the basis of this connection request and then establishes connection between the slot machine 10 and the game distribution server 200 (step S101 and step S201).

Next, the game distribution server 200 distributes, to the slot machine 10, game programs relating to symbol lateral scrolling processing (step S102). The slot machine 10 receives the game programs distributed from the game distribution server 200 (step S202) and downloads the received game programs to the ROM 42 (step S203).

Thereafter, the slot machine 10 performs certification for checking whether or not falsifications have been made in the downloaded game programs (step S204) and transmits the result of certification to the game distribution server 200 when the certification is confirmed (step S205). The game distribution server 200 receives the result of certification transmitted from the slot machine 10 (step S103).

As described above, the game distribution server 200 distributes game programs, which enables updating the content of the symbol lateral scrolling processing in the gaming system 1.

As described above, the gaming systems 1 according to the first and second embodiments include a plurality of slot machines 10 which can communicate with one another through communication lines, each slot machine 10 including the lower image display panel 16 (the main display) and the upper image display panel 33 (the sub display) capable of arranging symbols thereon, and the mother board 40 (the controller) programmed to execute the following processing; (a) processing for executing normal games in which symbols are rearranged in the lower image display panel 16, (b) processing for executing bonus games (special games) when symbols are rearranged on the lower image display panel 16 in specific patterns during the aforementioned normal games, (c) processing for changing symbols arranged on the upper image display panel 33 in such a way as to scroll symbols in the lateral direction in the display zone 2 comprising the upper image display panels 33 in the respective slot machines 10, the upper image display panels 33 being connected laterally to one another, (d) processing for stopping the changing of symbols at predetermined timing in the aforementioned processing (c), and (e) processing for offering a payout on the basis of the symbol arranged in the upper image display panel 33 at the time when the changing of symbols is stopped in the processing (d).

According to the aforementioned system 1, games are executed using the display zone 2 comprising the upper image display panels 33 included in the respective slot machines 10, the upper image display panels 33 being connected to one another. This causes players playing games in the respective slot machines 10 forming the gaming system 1 to have feeling of playing common games.

Further, the lateral scrolling of symbols in the display zone 2 is stopped at predetermined timing, and accordingly, the players cannot know when the symbol lateral scrolling will be stopped.

This can cause the players to have higher expectations for when the lateral scrolling will be stopped and payouts will be offered, namely for whether the lateral scrolling will be stopped during normal games or during bonus games (special games). This can offer new entertainment characteristics.

Further, the display zone 2 can be provided by connecting the upper image display panels 33 included in the respective slot machines 10 to one another, not by preliminarily providing an integrated common display. This enables executing common games in the plurality of slot machines 10 using the display zone 2 and also enables activating the respective slot machines 10 individually. That is, by switching through software within the respective slot machines 10, common games can be executed in the plurality of slot machines 10, and also, the respective slot machines 10 can be activated individually. This eliminates the necessity of using the respective slot machines 10 as machines dedicated to games using the display zone 2, thereby enabling effective utilization of the bodies.

While, in the first and second embodiments, there have been described cases where lateral scrolling of symbols 3 in the display zone 2 is stopped at timing determined using random numbers and then payouts are offered, regardless of whether the game state is normal games or bonus games (special games), in the present invention, the timing of stopping may be determined in such a manner that lateral scrolling of symbols in the display zone is stopped only during normal games or only during special games.

While, in the first and second embodiments, there have been described cases where lateral scrolling of symbols in the display zone 2 is stopped at determined timing, the types of the symbols 3 stopped on the upper image display panels 33 in the respective slot machines 10 are determined, and then, payouts are offered according to the types, in the present invention, symbols to be stopped on the sub displays of the respective slot machines may be determined first, and on the basis of the result of the determination, the timing of stopping lateral scrolling of symbols in the display zone may be determined. For example, after "750" is determined as a symbol to be stopped in the sub display in a single slot machine and "MEGA" is determined as a symbol to be stopped in the sub display in another slot machine, the timing of stopping the lateral scrolling may be determined in such a way as to realize the aforementioned stop state.

While, in the first and second embodiments, there have been described cases where the display zone 2 is formed from the upper image display panels 33 in the plurality of slot machines 10), the upper image display panels 33 being connected to one another without any gap therebetween (they are physically connected to one another), the display zone according to the present invention may be formed from a plurality of sub displays which are imaginarily connected to one another, for example, in such a way that they are arranged with predetermined gaps interposed therebetween.

While, in the first and second embodiments, the gaming system 1 includes the five slot machines 10, there is no particular limitation on the number of slot machines forming the gaming system, in the present invention. Further, the number of slot machines forming the gaming system is not necessarily kept constant. For example, the gaming system may include a plurality of slot machines selected from a plurality of slot machines, for example, such that the gaming system comprises five slot machines selected from 10 slot machines at predetermined timing.

While, in the first and second embodiments, the plurality of slot machines 10 are placed such that they are arranged laterally, the placement of the slot machines is not limited to the case, in the present invention. The plurality of slot machines may be placed such that they form an annular shape or an arc shape when viewed in a plane.

Further, while, in the first and second embodiments, there have been described cases where a single symbol sequence is displayed in the display zone, but the number of symbol sequences displayed in the display zone may be two or more.

In cases where the number of symbol sequences is two or more, the number of payouts in each slot machine is determined on the basis of a plurality of symbols stop-displayed on the sub display. As a determination method therefor, the number of payouts may be preliminarily defined in association with the respective symbols, and the total sum of payouts defined in association with a plurality of symbols stop-displayed in the sub display may be determined as the number of payouts. Also, when the combination of a plurality of symbols stop-displayed in the sub display is a winning combination, the number of payouts corresponding to this winning combination may be offered.

Third Embodiment

While, in the first and second embodiments, there have been described cases where symbols are displayed in the display blocks 28 in the lower image display panels 16, namely the slot machines according to the present invention are video slot machines, the present invention is not limited to the case.

Figure 17:
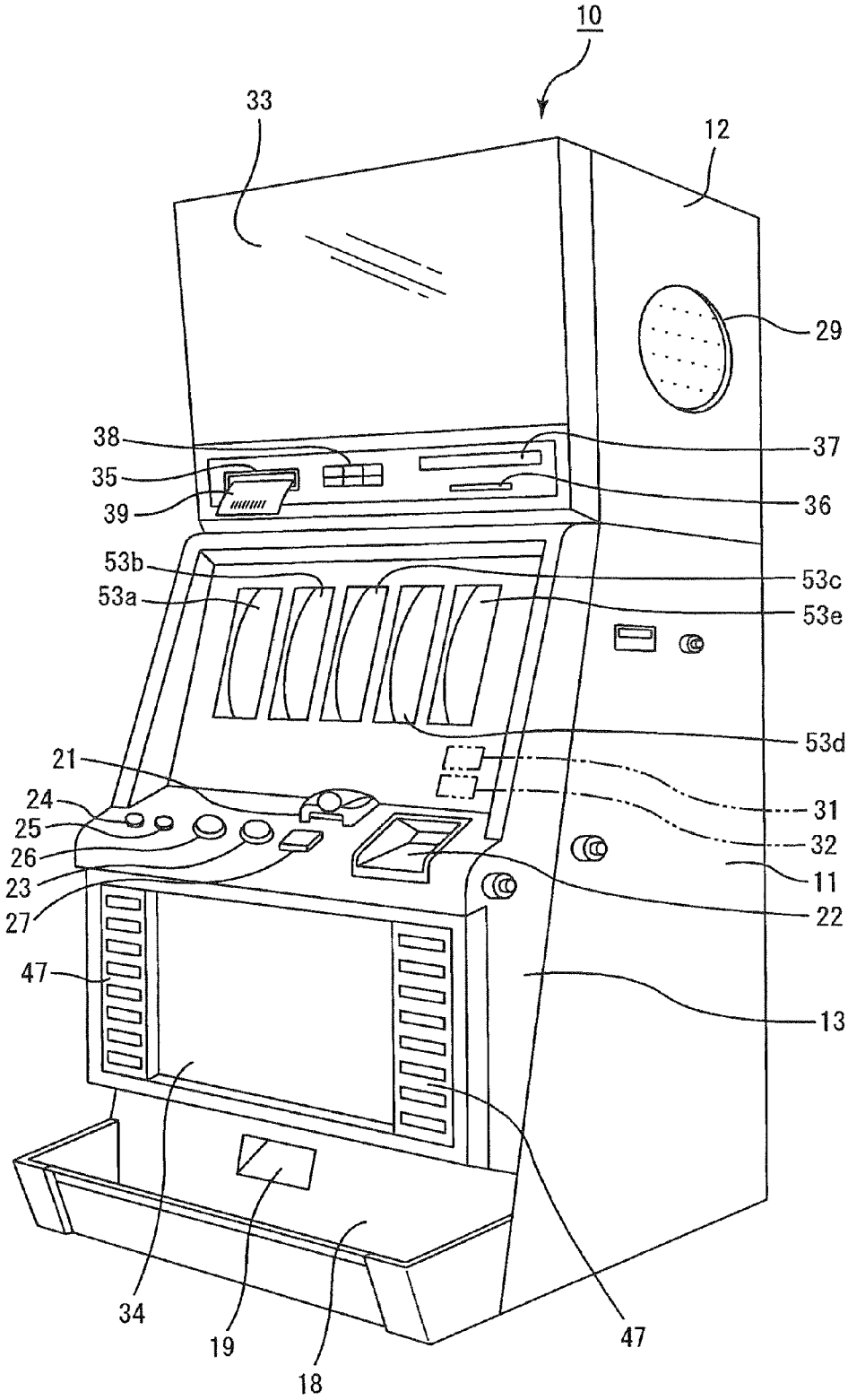
FIG. 17 is a perspective view illustrating the external appearance of a slot machine which is a constituent of a gaming system according to a third embodiment of the present invention.

FIG. 17 is a perspective view illustrating the external appearance of a slot machine which is a constituent of a gaming system according to a third embodiment of the present invention. In FIG. 17, the same structures as those illustrated in FIG. 3 are designated by the same reference characters as those in FIG. 3.

The slot machine illustrated in FIG. 17 is different from the slot machine 10 illustrated in FIG. 3, in that games are executed using five rotational reels 53*a* to 53*e*.

As illustrated in FIG. 17, the five rotational reels 53*a* to 53*e* are provided near the back surface of the main door 13, such that the respective rotational reels 53*a* to 53*e* can be viewed through a display window 57 formed substantially at the center portion of the main door 13. In the present invention, it is also possible to employ mechanical slot machines including rotational reels, as described above.

Although the present invention has been described with reference to embodiments thereof, these embodiments merely illustrate specific examples, not restrict the present invention. The specific structures of respective means and the like can be designed and changed as required. Furthermore, there have been merely described most preferable effects of the present invention, as the effects of the present invention, in the embodiments of the present invention. The effects of the present invention are not limited to those described in the embodiments of the present invention.

Further, in the aforementioned detailed description, characteristic portions have been mainly described, for ease of understanding the present invention. The present invention is not limited to the embodiments described in the aforementioned detailed description, but can be also applied to other embodiments over a wider range of applications. Further, the terms and phrases used in the present specification have been used for clearly describing the present invention, not for limiting the interpretation of the present invention. Further, those skilled in the art will easily conceive other structures, systems, methods and the like which are included in the concept of the present invention, from the concept of the present invention described in the present specification. Accordingly, the description of the claims is intended to include equivalent structures that fall within the technical scope of the invention. Further, the abstract aims at enabling engineers and the like who belong to the present technical field but are not familiar with the patent office and public institutions, the patent, law terms and technical terms to immediately understand the technical content and the essence of the present application through brief studies. Accordingly, the abstract is not intended to restrict the scope of the invention which should be evaluated from the description of the claims. It is desirable that literatures and the like which have been already disclosed are sufficiently studied and understood, in order to sufficiently understand the objects of the present invention and the specific effects of the present invention.

In the aforementioned detailed description, there has been described processing to be executed by computers. The aforementioned description and expressions have been described for the sake of enabling those skilled in the art to understand the present invention most effectively. In the present specification, each step for deriving a single result should be understood to be self-consistent processing. Further, each step includes transmission, reception, recording and the like of electric or magnetic signals. Although, in the processing at each step, such signals have been expressed as bits, values, symbols, characters, terms, numerical characters and the like, it should be noticed that they have been merely used for convenience of description. Further, although the processing at each step was described using expressions common to human behaviors in some cases, the processes described in the present specification are to be executed by various types of devices, in principle. Further, other structures required for conducting each step will be apparent from the aforementioned description.

What is claimed as new and desired to be secured by Letters Patent of the United States is:

1. A gaming system comprising a plurality of slot machines which can communicate with one another through communication lines, each slot machine comprising a main display and a sub display which are capable of arranging symbols thereon, and a controller programmed to execute processes of:

(a) executing games in which symbols are rearranged on said main display;

(b) changing symbols arranged on said sub display in such a way as to scroll symbols in a lateral direction in a display zone comprising sub displays in said respective slot machines, the sub displays being connected laterally to one another;

(c) stopping changing of symbols in said process (b) at predetermined timing; and (d) providing an award on a basis of the symbol arranged on said sub display upon stopping the changing of symbols in said process (c).

2. The gaming system according to claim 1, wherein said process (b) is a process for changing symbols arranged on said sub display in such a way as to scroll symbols in the lateral direction in the display zone comprising the sub displays in said respective slot machines, the sub displays being connected laterally and imaginarily to one another.

3. A gaming system comprising a plurality of slot machines which can communicate with one another through communication lines, each slot machine comprising a main display and a sub display which are capable of arranging symbols thereon, and a controller programmed to execute processes of:

(a) executing normal games in which symbols are rearranged on said main display;

(b) executing special games, when symbols are rearranged in specific patterns on said main display during said normal games;

(c) changing symbols arranged on said sub display in such a way as to scroll symbols in a lateral direction in a display zone comprising the sub displays in said respective slot machines, the sub displays being connected laterally to one another;

(d) stopping the changing of symbols in said process (c) at predetermined timing; and (e) providing an award on a basis of the symbol arranged on said sub display upon stopping the changing of symbols in said process (d).

4. The gaming system according to claim 3, wherein said process (c) is a process for changing symbols arranged on said sub display in such a way as to scroll symbols in the lateral direction in the display zone comprising the sub displays in said respective slot machines, the sub displays being connected laterally and imaginarily to one another.

5. The gaming system according to claim 3, wherein said process (d) is a process for stopping the changing of symbols in said process (c) at predetermined timing during normal games.

6. The gaming system according to claim 3, wherein said process (d) is a process for stopping the changing of symbols in said process (c) at predetermined timing during special games.

7. A method for controlling gaming machines for use in a gaming system comprising a plurality of slot machines which can communicate with one another through communication lines, each slot machine comprising a main display and a sub display which are capable of arranging symbols thereon, and a controller, the method comprising the steps of:

(a) causing said controller to execute games in which symbols are rearranged on said main display;

(b) causing said controller to change symbols arranged on said sub display in such a way as to scroll symbols in a lateral direction in a display zone comprising the sub displays in said respective slot machines, the sub displays being connected laterally to one another;

(c) causing said controller to stop the changing of symbols in said step (b) at predetermined timing; and (d) causing said controller to provide an award on the basis of the symbol arranged on said sub display upon stopping the changing of symbols in said step (c).

8. The method for controlling gaming machines according to claim 7, wherein said step (b) is a step of causing said controller to change symbols arranged on said sub display in such a way as to scroll symbols in the lateral direction in the display zone comprising the sub displays in said respective slot machines, the sub displays being connected laterally and imaginarily to one another.

* * * * *